US010093091B2

(12) United States Patent
Kanegae

(10) Patent No.: US 10,093,091 B2
(45) **Date of Patent: *Oct. 9, 2018**

(54) LIQUID EJECTING HEAD AND LIQUID EJECTING APPARATUS

(71) Applicant: SEIKO EPSON CORPORATION, Tokyo (JP)

(72) Inventor: Takahiro Kanegae, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/585,797

(22) Filed: May 3, 2017

(65) Prior Publication Data

US 2017/0232749 A1 Aug. 17, 2017

Related U.S. Application Data

(63) Continuation of application No. 14/995,875, filed on Jan. 14, 2016, now Pat. No. 9,682,551.

(30) Foreign Application Priority Data

Feb. 9, 2015 (JP) ..... 2015-023499

(51) Int. Cl.
*B41J 2/14* (2006.01)
*B41J 2/055* (2006.01)
(Continued)

(52) U.S. Cl.
CPC ..... *B41J 2/055* (2013.01); *B41J 2/14201* (2013.01); *B41J 2/14233* (2013.01);
(Continued)

(58) Field of Classification Search
CPC ..... B41J 2/14145
See application file for complete search history.

(56) References Cited

U.S. PATENT DOCUMENTS 6,616,270 B1 * 9/2003 Miyata ..... B41J 2/14233 347/68
9,682,551 B2 * 6/2017 Kanegae ..... B41J 2/14233
(Continued)

FOREIGN PATENT DOCUMENTS

EP 0759361 A 2/1997
JP 2002-067305 A 3/2002
(Continued)

OTHER PUBLICATIONS

Office Action issued in U.S. Appl. No. 14/995,875 dated Sep. 20, 2016.

(Continued)

*Primary Examiner* — Shelby Fidler
(74) *Attorney, Agent, or Firm* — Workman Nydegger

(57) ABSTRACT

A liquid ejecting head includes: a plurality of pressure generating chambers communicating with nozzles through which a liquid is ejected; a manifold communicating with the plurality of pressure generating chambers; a flexible member that has a surface on one side which defines at least a part of a wall of the manifold, that has a surface on the other side, on which an adhesive layer is formed, and that has a compliance region, which is able to perform deflection in response to pressure fluctuation in the manifold, in a region in which the adhesive layer is formed; a compliance space disposed on a side opposite to the manifold through the flexible member; a cap member facing the flexible member through the compliance space; and a frame-like member that is disposed between the flexible member and the cap member and has a cantilever, in which the cantilever is fixed to at least a part of the flexible member of the compliance region and has an unfixed region which is not fixed to the cap member on the distal end side thereof.

16 Claims, 17 Drawing Sheets

(51) Int. Cl.
*B41J 2/175* (2006.01)
*B41J 2/165* (2006.01)

(52) U.S. Cl.
CPC ..... *B41J 2/16505* (2013.01); *B41J 2/175* (2013.01); *B41J 2002/14241* (2013.01); *B41J 2002/14266* (2013.01); *B41J 2002/14419* (2013.01)

(56) References Cited

U.S. PATENT DOCUMENTS

| | | | |
|---|---|---|---|
| 2003/0067511 | A1 | 4/2003 | Okazawa |
| 2003/0231230 | A1 | 12/2003 | Shimamoto et al. |
| 2005/0195248 | A1 | 9/2005 | Nagashima |
| 2006/0066690 | A1 | 3/2006 | Katayama |
| 2006/0132551 | A1 | 6/2006 | Chikamoto |
| 2008/0165228 | A1 | 7/2008 | Kang et al. |
| 2012/0069093 | A1 | 3/2012 | Kuwata et al. |
| 2013/0257993 | A1 | 10/2013 | Ono et al. |
| 2014/0232796 | A1 | 8/2014 | Kimura et al. |
| 2015/0029266 | A1 | 1/2015 | Fukuda |
| 2015/0042719 | A1 | 2/2015 | Fukuzawa et al. |
| 2015/0077469 | A1 | 3/2015 | Kohda et al. |

FOREIGN PATENT DOCUMENTS

| | | | |
|---|---|---|---|
| JP | 2006-095725 | A | 4/2006 |
| JP | 2006-347036 | A | 12/2006 |
| JP | 2012-061714 | A | 3/2012 |

OTHER PUBLICATIONS

Notice of Allowance issued in U.S. Appl. No. 14/995,875 dated Feb. 16, 2017.

European Search Report for Application No. 16153663.6 dated Jul. 12, 2016.

* cited by examiner

LIQUID EJECTING HEAD AND LIQUID EJECTING APPARATUS

This application is a continuation of U.S. patent application Ser. No. 14/995,875 filed on Jan. 14, 2016, entitled "LIQUID EJECTING HEAD AND LIQUID EJECTING APPARATUS," which issued as U.S. Pat. No. 9,682,551 on 06/20/2017, which claims priority to Japanese Patent Application No: 2015-023499, filed Feb. 9, 2015 all of which applications are hereby incorporated by reference in their entirety.

BACKGROUND

1. Technical Field

The present invention relates to a liquid ejecting head that ejects a liquid from a nozzle and a liquid ejecting apparatus, and particularly to an ink jet-type recording head that ejects ink as the liquid and an ink jet-type recording apparatus.

2. Related Art

As an ink jet-type recording head which is a representative example of a liquid ejecting head that ejects a droplet, there is a recording head which includes a nozzle and a flow path such as a pressure generating chamber communicating with the nozzle, and in which a pressure generator causes pressure in ink in the pressure generating chamber to be changed such that an ink droplet is discharged from the nozzle.

According to the ink jet-type recording head, there has been proposed a recording head in which a so-called compliance region that is formed by a flexible film demarcating a part of a manifold, with which a plurality of pressure generating chambers communicate, and that absorbs pressure fluctuation of a liquid in the manifold by deforming the film (for example, see JP-A-2006-95725).

However, a problem arises in that, when rapid deflection of the compliance region is performed in an initial stage from a print stand-by state in which ink is not ejected to the time when ejection of the ink is started, that is, when the printing is started, variations in ejection characteristics of the ink in the initial stage, and particularly in the ink weight, will occur in a state in which the manifold is filled with the ink during a printing operation such that smooth deflection of the compliance region occurs, and deformation is performed in a deflection direction by the ink consumed.

Further, such problems arise not only in the ink jet-type recording head but also similarly in a liquid ejecting apparatus that ejects a liquid except for the ink.

SUMMARY

An advantage of some aspects of the invention is to provide a liquid ejecting head and a liquid ejecting apparatus in which it is possible to prevent variations in ejection characteristics of a liquid.

Aspect 1

According to an aspect of the invention, there is provided a liquid ejecting head including: a plurality of pressure generating chambers communicating with nozzles through which a liquid is ejected; a manifold communicating with the plurality of pressure generating chambers; a flexible member that has a surface on one side which defines at least a part of a wall of the manifold, that has a surface on the other side, on which an adhesive layer is formed, and that has a compliance region, which is able to perform deflection in response to pressure fluctuation in the manifold, in a region in which the adhesive layer is formed; a compliance space disposed on a side opposite to the manifold through the flexible member; a cap member facing the flexible member through the compliance space; and a frame-like member that is disposed between the flexible member and the cap member and has a cantilever, in which the cantilever is fixed to at least a part of the flexible member of the compliance region and has an unfixed region which is not fixed to the cap member on the distal end side thereof.

In this case, the cantilever is provided, and thereby it is possible to prevent the compliance region of the flexible member from being rapidly deformed in deflection in an initial stage of the pressure fluctuation in the manifold and the compliance region can absorb the pressure fluctuation in the manifold. Accordingly, it is possible to prevent variations in ejection characteristics of a liquid and, particularly in the weight of the liquid in an initial stage of and during the pressure fluctuation in the manifold. In addition, the cantilever is provided, and thereby it is possible to prevent the compliance region of the flexible member from adhering to the cap member such that it is possible to prevent malfunction due to adherence of the flexible member to the cap member.

Aspect 2

In the liquid ejecting head according to Aspect 1, it is preferable that the frame-like member has a first notch provided on a surface facing the cap member, in which the surface of the frame-like member on the cantilever side from the first notch on the surface thereof facing the cap member becomes the unfixed region. In this case, the first notch is provided in the frame-like member, and thereby it is possible to prevent the adhesive, with which the frame-like member and the cap member adhere to each other, from flowing out to the cantilever side from the first notch such that it is possible to form the unfixed region with ease and high accuracy.

Aspect 3

In the liquid ejecting head according to Aspect 1 or 2, it is preferable that the cantilever has a thickness which is thinner on the distal end side than on the support point side in a direction in which the compliance region faces the cap member. In this case, the cantilever is thinner on the distal end side, and thereby it is possible to prevent the adhesive, with which the frame-like member and the cap member adhere to each other on the distal end side, from flowing out such that it is possible to form the unfixed region on the distal end side of the cantilever with ease and high accuracy.

Aspect 4

In the liquid ejecting head according to any one of Aspects 1 to 3, it is preferable that the cap member has a second notch in a surface facing the cantilever, in which the surface of the cap member on the distal end side of the cantilever from the second notch of the surface thereof facing the cantilever is not fixed to the frame-like member. In this case, the second notch is provided in the cap member, and thereby it is possible to prevent the adhesive, with which the frame-like member and the cap member adhere to each other, from flowing out to the cantilever from the second notch such that it is possible to form the unfixed region with ease and high accuracy.

Aspect 5

In the liquid ejecting head according any one of Aspects 1 to 4, it is preferable that the surface of the cap member on the distal end side of the cantilever of the cap member on the surface thereof facing the cantilever is further recessed than the support point side of the cantilever. In this case, the recessed portion is provided in the cap member, and thereby it is possible to prevent the adhesive, with which the frame-like member and the cap member adhere to each other, from flowing out to the cantilever from the recessed portion such that it is possible to form the unfixed region with ease and high accuracy.

Aspect 6

In the liquid ejecting head according to any one of Aspects 1 to 5, it is preferable that a flow path member defining a wall surface of the manifold is an opening in a surface of the flow path member, which faces the cantilever, the opening defining the manifold is fixed to the flexible member such that the opening is positioned on the support point side from the distal end side of the cantilever. In this case, since the frame-like member can receive a load produced when the flow path member is joined to the flexible member and the frame-like member, it is possible to reliably perform the joining between the flow path member and the flexible member. Accordingly, it is possible to prevent a gap from being generated due to an insufficient load when the flow path member is joined to the flexible member, and to prevent a defect such as bubbles being caught from occurring.

Aspect 7

In the liquid ejecting head according to any one of Aspects 1 to 6, it is preferable that the liquid ejecting head further includes: an island-like member disposed in the compliance region to be apart from the frame-like member, between the flexible member and the cap member, in which a surface of the island-like member, which faces the flexible member, is fixed to the flexible member and a surface of the island-like member on the side facing the cap member is not fixed to the cap member. In this case, the island-like member is provided, and thereby it is possible to prevent the compliance region of the flexible member from adhering to the cap member. In addition, the island-like member is not fixed to the cap member, and thereby it is possible to prevent the deformation of the compliance region to the manifold side from being regulated such that the compliance region can reliably perform the absorption of the pressure fluctuation in the manifold.

Aspect 8

In the liquid ejecting head according to Aspect 7, it is preferable that the island-like member is thinner in thickness than the cantilever on the support point side. In this case, it is possible to prevent the island-like member from coming into contact with the cap member and it is possible to prevent the island-like member from adhering to the cover head.

Aspect 9

In the liquid ejecting head according to Aspect 8, it is preferable that the island-like member has the same thickness as the cantilever on the distal end side. In this case, it is possible to easily form the island-like member and the frame-like member having the cantilever simultaneously.

Aspect 10

In the liquid ejecting head according to Aspects 1 to 9, it is preferable that a surface of the cantilever on the distal end side, which faces the cap member, is subjected to a water repellent treatment. In this case, even in a case where the cantilever and the cap member are in contact with each other, it is possible to prevent the water moisture due to condensation from attaching such that it is possible to prevent the adherence due to the water moisture.

Aspect 11

In the liquid ejecting head according to Aspects 1 to 10, it is preferable that a surface of the cap member, which faces the cantilever and faces the distal end side of the cantilever, is subjected to a water repellent treatment. In this case, even in a case where the cantilever and the cap member are in contact with each other, it is possible to prevent the water moisture due to condensation from attaching such that it is possible to prevent the adherence due to the water moisture.

Aspect 12

According to another aspect of the invention, there is provided a liquid ejecting apparatus including: the liquid ejecting head according to the aspects described above.

In this case, it is possible to realize the liquid ejecting apparatus in which the compliance region absorbs the pressure fluctuation of the liquid in the manifold, variations in the liquid ejection characteristics due to the pressure fluctuation is prevented, and the compliance region is prevented from adhering to the cap member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on embodiments.

Embodiment 1

Figure 1:
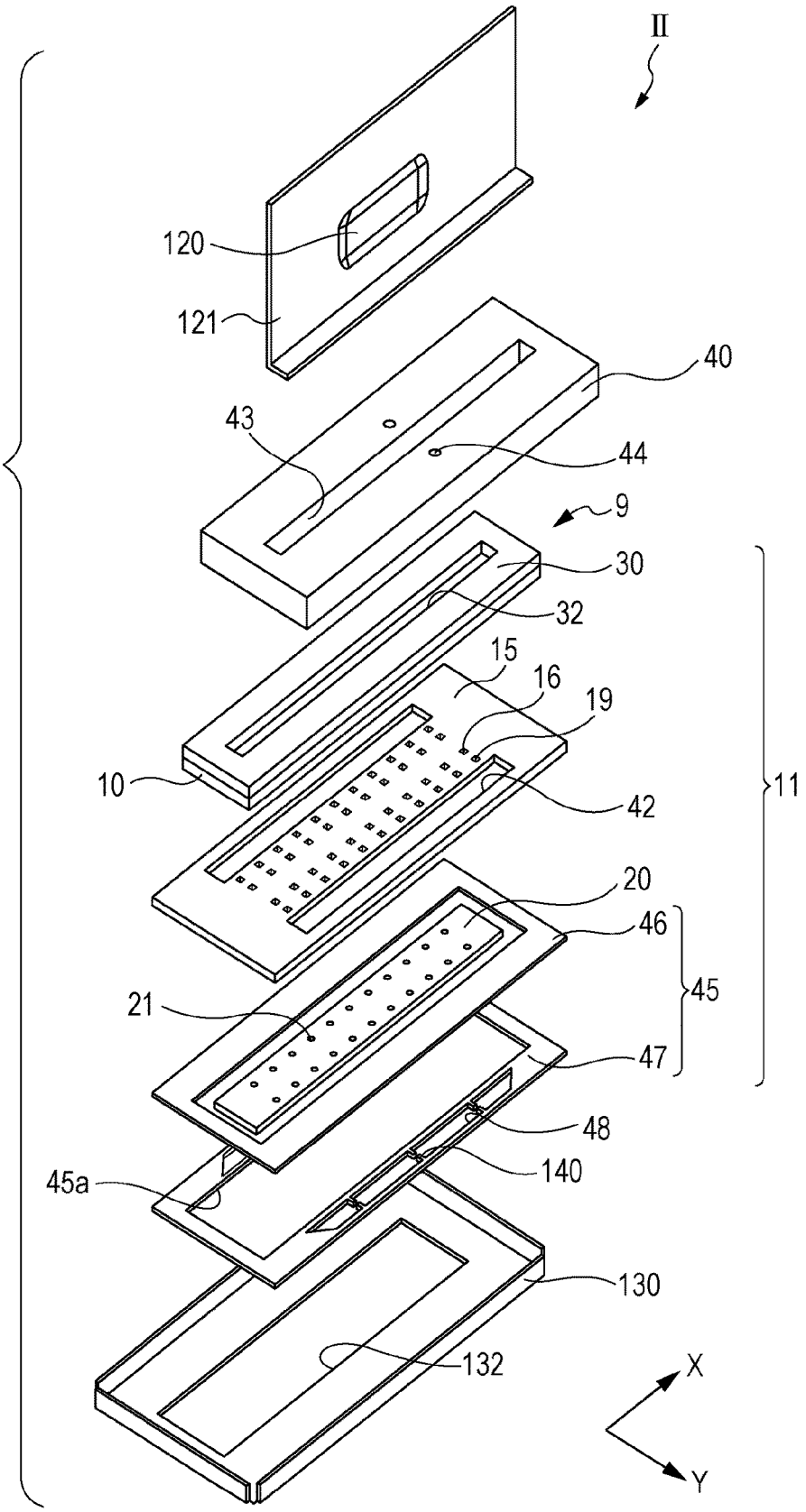
FIG. 1 is an exploded perspective view illustrating a recording head according to Embodiment 1.
Figure 2:
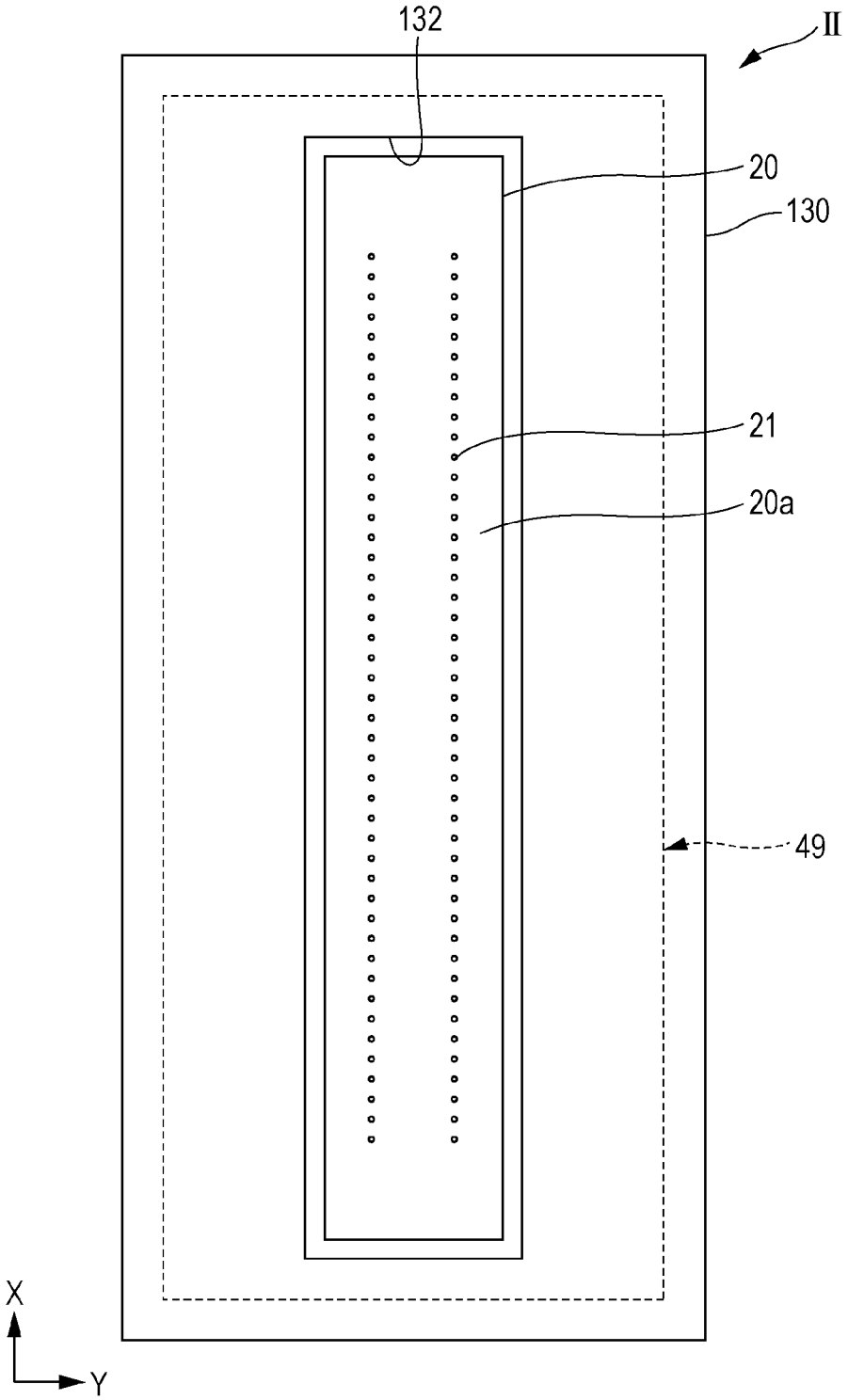
FIG. 2 is a plan view illustrating the recording head according to Embodiment 1.
Figure 3:
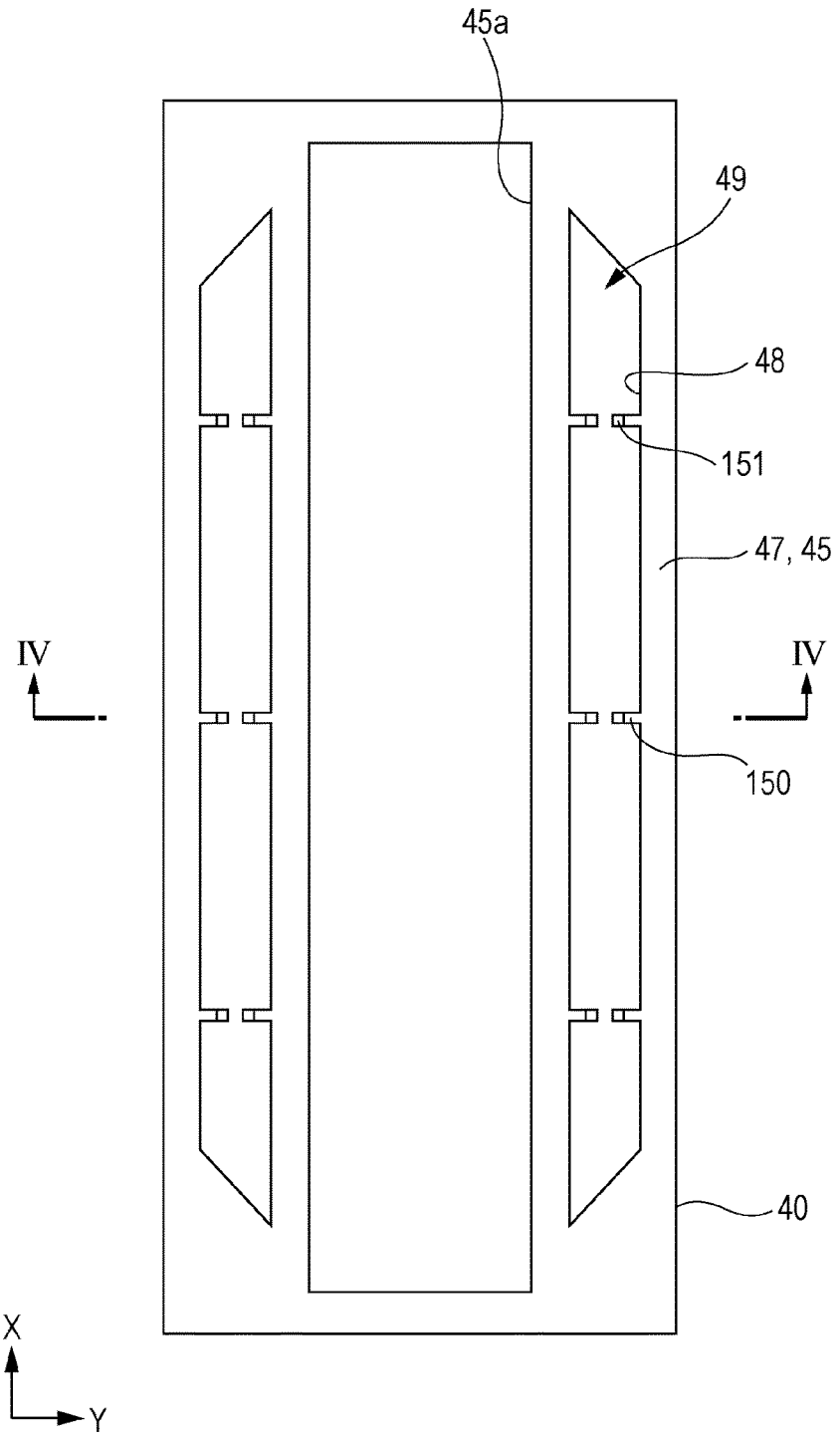
FIG. 3 is a plan view illustrating a compliance substrate according to Embodiment 1.
Figure 4:
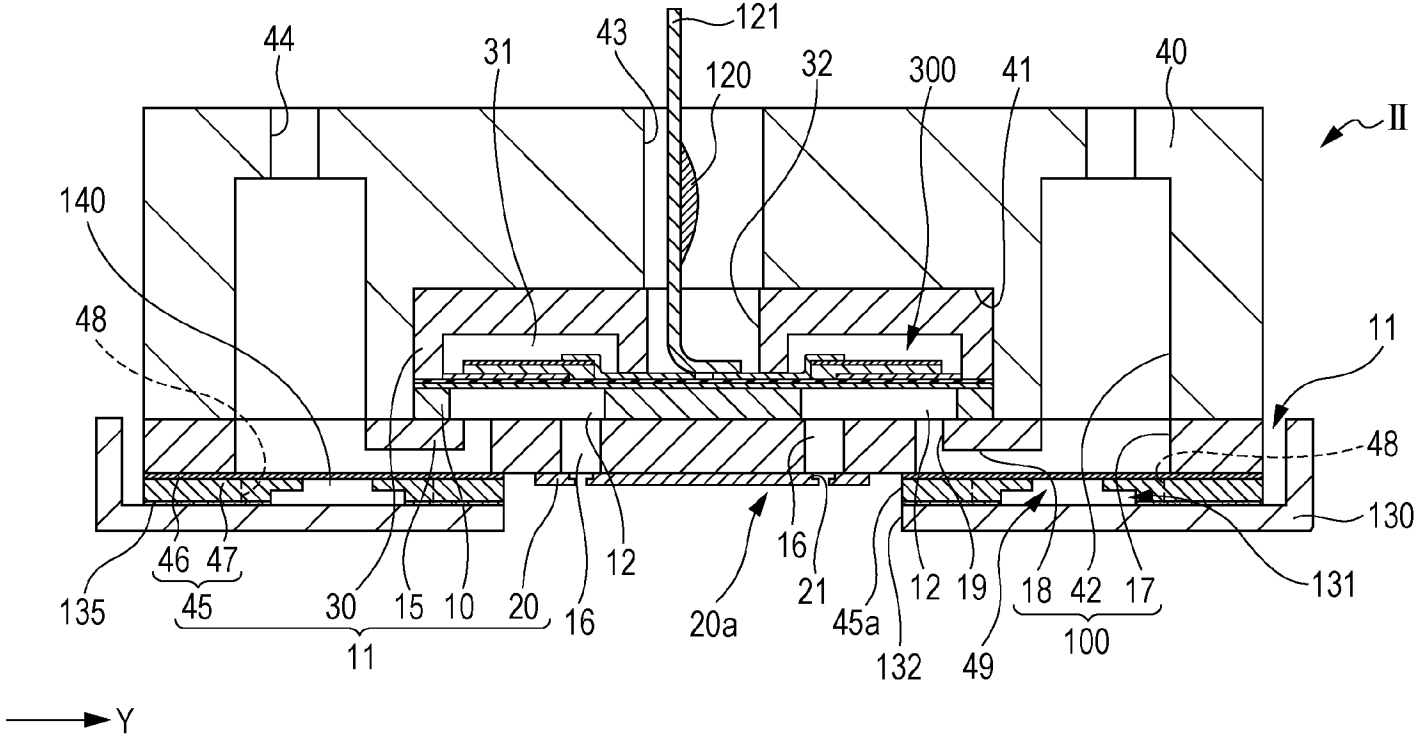
FIG. 4 is a sectional view illustrating the recording head according to Embodiment 1.
Figure 5:
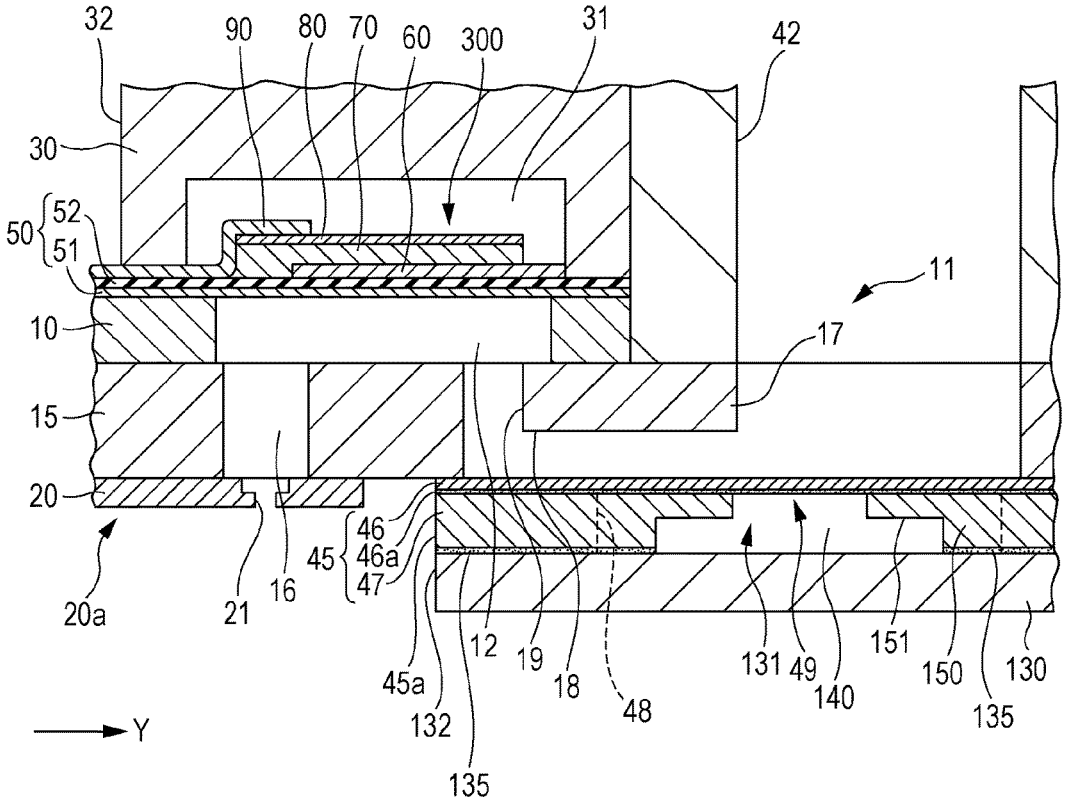
FIG. 5 is a sectional view illustrating main components of the recording head according to Embodiment 1.

FIG. 1 is an exploded perspective view illustrating an ink jet-type recording head as an example of a liquid ejecting head according to Embodiment 1 of the invention. FIG. 2 is a plan view illustrating the ink jet-type recording head. In addition, FIG. 3 is a plan view illustrating a compliance substrate and FIG. 4 is a sectional view illustrating the recording head taken along line IV-IV in FIG. 3. FIG. 5 is an enlarged sectional view illustrating main components in FIG. 4.

As illustrated in the FIG. 1 to FIG. 4, the ink jet-type recording head II (hereinafter, also simply referred to as a recording head II) includes a plurality of members such as a head main body 11, a case member 40 fixed to one surface side of the head main body 11, a cover head 130 fixed to the other surface side of the head main body 11. In addition, the head main body 11 of Embodiment 1 includes a flow path formation substrate 10, a communicating plate 15 provided on one surface side of the flow path formation substrate 10, a nozzle plate 20 provided on the communicating plate 15 on the side opposite to the flow path formation substrate 10, a protection substrate 30 provided on the flow path formation substrate 10 on the side opposite to the communicating plate 15, and a compliance substrate 45 provided on the communicating plate 15 on the surface side on which the nozzle plate 20 is provided.

The flow path formation substrate 10 constituting the head main body 11 can be formed of a metal such as stainless steel or Ni, a ceramic material represented by $ZrO_2$ or $Al_2O_3$, a glass-ceramic material, an oxide such as MgO, $LaAlO_3$, or the like. In Embodiment 1, the flow path formation substrate 10 is formed of a silicon single crystal substrate. In the flow path formation substrate 10, pressure generating chambers 12 that are formed through anisotropic etching from one surface side are partitioned by a plurality of diaphragms and are arranged in parallel in a direction in which a plurality of nozzles 21 which eject ink are arranged in parallel. From here on, this direction is referred to as a parallel-arrangement direction of the pressure generating chambers 12 or a first direction X. In addition, in the flow path formation substrate 10, a plurality of rows in which the pressure generating chambers 12 are arranged in parallel in the first direction X are provided and two rows of pressure generating chambers 12 are provided in Embodiment 1. A row-arrangement direction, in which the plurality of rows of pressure generating chambers 12 that are formed in the first direction X are arranged, is referred to as a second direction Y, from here on. Further, a direction which intersects with both the first direction X and the second direction Y is referred to as a third direction Z. In Embodiment 1, the first direction X, the second direction Y, and the third direction Z intersect with one another in the direction orthogonal to each other; however, the directions may intersect with one another in a direction which is not orthogonal to each other.

In addition, in the flow path formation substrate 10, a supply path or the like which has a smaller opening area than the pressure generating chamber 12 and causes flow path resistance to be produced to ink that flows into the pressure generating chamber 12 may be provided on one end side of the pressure generating chamber 12 in the second direction Y.

In addition, in one surface side of the flow path formation substrate 10, the communicating plate 15 and the nozzle plate 20 are stacked in this order. That is, the flow path formation substrate 10 includes the communicating plate 15 provided on one surface of the flow path formation substrate 10 and the nozzle plate 20 that has the nozzle 21 which is provided on the surface side of the communicating plate 15 opposite to the flow path formation substrate 10.

A nozzle communication path 16 through which the pressure generating chamber 12 communicates with the nozzle 21 is provided in the communicating plate 15. The communicating plate 15 has an area larger than the flow path formation substrate 10 and the nozzle plate 20 has an area smaller than the flow path formation substrate 10. The communicating plate 15 is provided, and thereby the nozzle 21 of the nozzle plate 20 is separated from the pressure generating chamber 12. Therefore, ink in the pressure generating chamber 12 is unlikely to be affected by thickening of ink due to evaporation of water moisture which occurs in the ink in the vicinity of the nozzle 21. In addition, since the nozzle plate 20 may be disposed only to cover an opening of the nozzle communication path 16 through which the pressure generating chamber 12 communicates with the nozzle 21, it is possible to relatively decrease the area of the nozzle plate 20 and thus it is possible to reduce cost because the area of the flow path formation substrate 10 can be less than that of the communicating plate 15. Further, in the Embodiment 1, a surface on which the nozzle 21 of the nozzle plate 20 is opened and through which ink droplets are discharged is referred to as a liquid ejection surface 20*a*.

In addition, a first manifold section 17 and a second manifold section 18 which configure a part of a manifold 100 are provided in the communicating plate 15.

The first manifold section 17 is provided to penetrate through the communicating plate 15 in the thickness direction (a stacking direction of the communicating plate 15 and the flow path formation substrate 10).

In addition, the second manifold section 18 is not provided to penetrate through the communicating plate 15 in the thickness direction but provided to be opened on the nozzle plate 20 side of the communicating plate 15.

Further, an opening shape of the manifold 100 on the nozzle plate 20 side has a longitudinal direction and a widthwise direction in an in-plane direction including the first direction X and the second direction Y. The manifold 100 has the longitudinal direction and the widthwise direction, which means that an aspect ratio of the opening of the manifold 100 on the nozzle plate 20 side is not 1 to 1. In addition, there is no particular limitation to the opening shape of the manifold 100 and, for example, the opening shape may be rectangular, trapezoidal, parallelogrammic, polygonal, elliptical, or the like. In Embodiment 1, since the pressure generating chambers 12 are arranged in parallel in the flow path formation substrate 10 in the first direction X, the manifold 100 which is a common liquid chamber communicating with the pressure generating chambers 12 is provided over the pressure generating chambers 12 arranged in parallel in the first direction X to have a trapezoidal shape which has the longitudinal direction in the first direction X, that is, which is elongated in the first direction X and which has the widthwise direction in the second direction Y, that is, which is short in the second direction Y. Similarly, the opening shape of the manifold 100 on the nozzle plate 20 side is trapezoidal to have the longitudinal direction in the first direction X and to have the widthwise direction in the second direction Y.

Further, a supply communication path 19 that communicates with one end portion of the pressure generating chamber 12 in the second direction Y is provided in the communicating plate 15 individually for each of the pressure generating chambers 12. Through the supply communication path 19, the second manifold section 18 communicates with the pressure generating chamber 12. In other words, in Embodiment 1, as separated flow paths through which the nozzle 21 communicates with the second manifold section 18, the supply communication path 19, the pressure generating chamber 12, and the nozzle communication path 16 are provided.

Such a communicating plate 15 can be formed of a metal such as stainless steel or nickel (Ni), ceramic such as zirconium (Zr), or the like. It is preferable that the communicating plate 15 is formed of a material having the same linear expansion coefficient as the flow path formation substrate 10. In other words, in a case where the communicating plate 15 is formed of a material having the linear expansion coefficient significantly different from that of the flow path formation substrate 10, distortion due to the different linear expansion coefficients between the flow path formation substrate 10 and the communicating plate 15 is produced when the members are heated or cooled. In Embodiment 1, the communicating plate 15 is formed of the same material as the flow path formation substrate 10, that is, a silicon single crystal substrate, and thereby it is possible to prevent an occurrence of distortion due to heat, cracking or peeling due to heat, or the like.

The nozzle 21 that communicates with each of the pressure generating chambers 12 through the nozzle communication path 16 is formed on the nozzle plate 20. In other words, the nozzles 21 eject the same type of liquid (ink) and are arranged in parallel in the first direction X and two rows of the nozzles 21 arranged in parallel in the first direction X are formed in the second direction Y.

Such a nozzle plate 20 can be formed of a metal such as stainless steel (SUS), an organic material such as a polyimide resin, a silicon single crystal substrate, or the like. When the nozzle plate 20 is formed of a silicon single crystal substrate, the nozzle plate 20 has the same linear expansion coefficient as the communicating plate 15. Accordingly, it is possible to prevent an occurrence of distortion due to heating or cooling, cracking or peeling due to heating, or the like.

Meanwhile, a vibration plate 50 is formed on the surface side opposite to the communicating plate 15 of the flow path formation substrate 10. In Embodiment 1, as the vibration plate 50, an elastic film 51 that is provided on the side of the flow path formation substrate 10 and is formed of silicon oxide, and an insulator film 52 that is provided on the elastic film 51 and is formed of zirconium oxide are provided. A liquid flow path such as the pressure generating chamber 12 is formed through anisotropic etching on the flow path formation substrate 10 from one surface side (surface side to which the nozzle plate 20 is joined) and the other surface of the liquid flow path such as the pressure generating chamber 12 is demarcated by the elastic film 51.

In addition, a piezoelectric actuator 300 is configured to include a first electrode 60, a piezoelectric layer 70, and a second electrode 80, which are stacked on the insulator film 52 of the vibration plate 50. Here, the piezoelectric actuator 300 is a portion in which the first electrode 60, the piezoelectric layer 70, and the second electrode 80 are included. In general, any one electrode of the piezoelectric actuator 300 is used as a common electrode and the other electrode and the piezoelectric layer 70 are configured to be patterned for each of the pressure generating chambers 12. Also, the piezoelectric actuator is configured to include one patterned electrode and the piezoelectric layer 70 such that a portion in which piezoelectric strain is produced due to application of a voltage to both electrodes is referred to as a piezoelectric active portion. In Embodiment 1, the first electrode 60 is provided as the common electrode of the piezoelectric actuators 300 and the second electrode 80 is provided as an individual electrode of the piezoelectric actuators 300; however, depending on a drive circuit or wiring, both of the electrodes may be used the other way around. In the above example, since the first electrode 60 is provided to be continuous over a plurality of the pressure generating chambers 12, the first electrode 60 functions as a part of the vibration plate; understandably, the first electrode is not limited thereto. For example, only the first electrode 60 may work as the vibration plate without providing the elastic film 51 and the insulator film 52 described above. In addition, the piezoelectric actuator 300 itself may function as the vibration plate, in practice. Here, in a case where the first electrode 60 is provided immediately on the flow path formation substrate 10, it is preferable that the first electrode 60 is protected using a protective film having insulation properties such that the first electrode 60 and the ink do not conduct to each other. In other words, in Embodiment 1, the configuration, in which the first electrode 60 is provided over the substrate (flow path formation substrate 10) through the vibration plate 50, is described as an example; however, the configuration is not limited thereto, and the first electrode 60 may be provided immediately on the substrate without providing the vibration plate 50. That is, the first electrode 60 may work as the vibration plate. In other words, to be on the substrate means to be immediately on the substrate and a state (above) in which another member is interposed therebetween.

Further, a lead electrode 90 formed of gold (Au) or the like, which is pulled out from the vicinity of an end portion of the second electrode 80 on the side opposite to the supply communication path 19 and extends over the vibration plate 50, is connected to the second electrode 80 which is an individual electrode of the piezoelectric actuator 300.

In addition, the protection substrate 30 having the same size as the flow path formation substrate 10 is joined to a surface of the flow path formation substrate 10 on the piezoelectric actuator 300 side which is a pressure generator. The protection substrate 30 has a holding section 31 which is a space that protects the piezoelectric actuator 300.

In addition, the case member 40 which, together with the head main body 11, demarcates the manifold 100 communicating with the plurality of pressure generating chambers 12, is fixed to the head main body 11. The case member 40 has substantially the same shape as the communicating plate 15 described above in a plan view, is joined to the protection substrate 30, and is also joined to the communicating plate 15 described above. Specifically, the case member 40 has a recessed section 41 having a depth on the protection substrate 30 side, with which the flow path formation substrate 10 and the protection substrate 30 are accommodated. The recessed section 41 has an opening area greater than a surface of the protection substrate 30 to which the flow path formation substrate 10 is joined. Also, in a state in which the flow path formation substrate 10 or the like is accommodated in the recessed section 41, an opening surface of the recessed section 41 on the nozzle plate 20 side is sealed by the communicating plate 15. A third manifold section 42 is hereby demarcated by the case member 40 and the head main body 11 on the peripheral section of the flow path formation substrate 10. Also, the first manifold section 17 and the second manifold section 18 provided in the communicating plate 15, and the third manifold section 42 demarcated by the case member 40 and the head main body 11 configure the manifold 100 of Embodiment 1. In other words, the manifold 100 includes the first manifold section 17, the second manifold section 18, and the third manifold section 42. In addition, the manifold 100 of Embodiment 1 is disposed on both outer sides of two rows of pressure generating chambers 12 in the second direction Y, and two manifolds 100 provided on both outer sides of the two rows of pressure generating chambers 12 are separately provided so as not to communicate with each other in the recording head II. In other words, one manifold 100 is provided to communicate with each row (row provided in parallel in the first direction X) of the pressure generating chambers 12 of Embodiment 1.

In addition, a guide path 44, which communicates with the manifold 100 and supplies the ink to the respective manifolds 100, is provided in the case member 40. In addition, a connection port 43, which communicates with a through-hole 32 of the protection substrate 30 and into which a wiring substrate 121 is inserted, is provided in the case member 40. Further, the wiring substrate 121 inserting into the connection port 43 is connected to the lead electrode 90. In addition, a drive circuit 120 is provided in the wiring substrate 121.

Further, the two manifolds 100 may communicate with each other on the upstream side of the recording head II, that is, to be more exact, in the upstream flow path which is connected to the guide path 44 communicating with the manifold 100 to be described below.

As a material of the case member 40, for example, a resin, a metal, or the like can be used. Incidentally, the case member 40 can be molded using a resin material, and thereby mass production can be performed at low cost.

In addition, as illustrated in FIG. 3 to FIG. 5, the compliance substrate 45 is provided on a surface in which the first manifold section 17 and the second manifold section 18 of the communicating plate 15 are opened. The compliance substrate 45 has substantially the same size as the communicating plate 15 described above in a plan view and a first exposure opening 45*a* which exposes the nozzle plate 20 is provided in the compliance substrate. Also, in a state in which the compliance substrate 45 exposes the nozzle plate 20 through the first exposure opening 45*a*, the opening of the first manifold section 17 and the second manifold section 18 on the liquid ejection surface 20*a* side is sealed.

In other words, the compliance substrate 45 demarcates a part of the manifold 100. Such compliance substrate 45 includes the flexible member 46 formed of a material having flexibility and a frame-like member 47 fixed to a side of the flexible member 46 opposite to the communicating plate 15. The flexible member 46 is formed of a flexible thin film (thin film with a thickness of 20 μm or less which is formed of, for example, polyphenylene sulfide (PPS), aromatic polyamide (aramid), or the like) and the frame-like member 47 is formed of a hard material such as a metal such as stainless steel (SUS) or the like, compared to the flexible member 46. Since a region of the frame-like member 47 which faces the manifold 100 becomes an opening 48 by removing the entire region in the thickness direction, one surface of the manifold 100 becomes the compliance region 49 that is sealed only by the flexible member 46 having flexibility. In other words, the opening 48 is provided in the frame-like member 47, and thereby the compliance space 131 which causes the flexible member 46 to be separated from a cover head 130 which is a cap member and it is possible to deform a part of the flexible member 46 as the compliance region 49 by the compliance space 131. Further, in Embodiment 1, one compliance region 49 is provided corresponding to one manifold 100. In other words, in Embodiment 1, since two manifolds 100 are provided, two compliance regions 49 are provided on both sides in the second direction Y with the nozzle plate 20 interposed.

Further, the flexible member 46 and the frame-like member 47 are formed by forming an adhesive layer through applying an adhesive over the entire one-side surface of the flexible member 46, then the frame-like member 47 is attached to the one-side surface on which the adhesive of the flexible member 46 is formed. Accordingly, as illustrated in FIG. 5, an adhesive layer 46*a* formed by the cured adhesive is formed in the compliance region 49 exposed through the opening 48 of the frame-like member 47. It is needless to say that the configuration is not limited thereto, and the adhesive layer 46*a* may not be formed in the compliance region 49 in the opening 48.

Here, as illustrated in FIG. 3, the compliance region 49 defined by the opening 48 has the longitudinal direction and the widthwise direction in the first direction X and the second direction Y. Further, the compliance region 49 has the longitudinal direction and the widthwise direction, which means that an aspect ratio of the compliance region 49 is not 1 to 1. In addition, there is no particular limitation to the shape of the compliance region 49 and, for example, the shape may be rectangular, trapezoidal, parallelogrammic, polygonal, elliptical, or the like. In Embodiment 1, since the opening of the manifold 100 described above on the compliance substrate 45 side is provided to have a trapezoidal shape which has the longitudinal direction in the first direction X and the widthwise direction in the second direction Y, similar to the opening shape of the manifold 100, the compliance region 49 is provided to have a trapezoidal shape which has the longitudinal direction in the first direction X and the widthwise direction in the second direction Y. It is possible to hereby provide the compliance region 49 having an area to the greatest extend with respect to the opening of the manifold 100 and it is possible to achieve miniaturization of the recording head II. The compliance region 49 does not need to have the same shape as the opening shape of the manifold 100 and may have a shape different from the opening shape of the manifold 100.

In addition, in Embodiment 1, a wall surface of the opening 48 in the widthwise direction, which defines the compliance region 49, is provided at a position facing the manifold 100 in the third direction Z. In other words, in the opening of the surface of the manifold 100, which faces the flexible member 46, the wall surface of the opening in the widthwise direction, which defines the manifold 100, is disposed at a position facing the frame-like member 47 in the third direction Z. Since it is possible to hereby receive, by the frame-like member 47, a load produced when the communicating plate 15 which is the flow path member and the flexible member 46 are joined, it is possible to reliably perform the joining between the communicating plate 15 and the flexible member 46. Accordingly, a gap can be formed due to an insufficient load during the joining between the communicating plate 15 and the flexible member 46, and thus it is possible to prevent an occurrence of a defect such as blocking of bubbles.

In addition, as illustrated in FIG. 4 and FIG. 5, the cover head 130 which is the cap member of Embodiment 1 is provided on the liquid ejection surface 20*a* side of the head main body 11.

A second exposure opening 132 which exposes the nozzle 21 is provided in the cover head 130. In Embodiment 1, the second exposure opening 132 has a size to expose the nozzle plate 20, that is, an opening having substantially the same size as the first exposure opening 45*a* of the compliance substrate 45.

In addition, in Embodiment 1, the cover head 130 is provided to have an end portion which is curved from the liquid ejection surface 20*a* side such that the cover head covers the side surface (surface intersecting with the liquid ejection surface 20*a*) of the head main body 11.

Such cover head 130 is joined to the side of the compliance substrate 45 opposite to the communicating plate 15 and seals a space on the side of the compliance region 49 opposite to the flow path (manifold 100). In other words, the cover head 130 which is the cap member is provided to cover the compliance regions 49 in a state in which the compliance space 131 is disposed between the compliance regions 49. In this manner, the compliance region 49 is covered with the cover head 130 which is the cap member, and thereby it is possible to prevent the compliance region 49 from being broken even when a recording medium such as paper comes into contact with the compliance region. In addition, the compliance region 49 is prevented from being attached with the ink (liquid), it is possible to wipe off the ink (liquid) attached on the surface of the cover head 130, for example, using a wiper blade or the like, and it is possible to prevent the recording medium from being stained with the ink or the like attached to the cover head 130.

In this manner, the compliance space 131 demarcated between the compliance region 49 and the cover head 130 is opened to the atmosphere on the outside of the recording head II. In Embodiment 1, a through-hole 48*a*, which penetrates through the frame-like member 47 in the thickness direction, is provided in one side of the respective compliance regions 49 in the first direction X, the through-hole 48*a* communicates with the opening 48, and thereby the compliance space 131 between the compliance region 49 and the cover head 130 is opened to the atmosphere on the outside through the through-hole 48*a*. Further, the through-hole 48*a* communicating with the compliance space 131 between the compliance region 49 and the cover head 130 may be opened to the atmosphere on the liquid ejection surface 20*a* side, on the side surface side, on the side (case member 40 side) opposite to the liquid ejection surface 20*a* of the recording head II, or the like. Here, since there is a concern that a defect, such as the ink flowing in from the opening opened to the atmosphere, blocking of an atmosphere open path, or the compliance region 49 attached with the ink, will occurs, it is preferable that the atmosphere open path (not illustrated) communicating with the through-hole 48*a* is opened to the outside on the side opposite to the liquid ejection surface 20*a*, that is, on the case member 40 side, and is opened to the atmosphere. Incidentally, in order to open the through-hole 48*a* to the atmosphere, an atmosphere open path (not illustrated) such as a groove or a through-hole may be provided in a member (a flow path formation substrate 10 or a communicating plate 15) constituting the recording head II and communication with the outside is performed through the atmosphere open path. In Embodiment 1, the through-hole 48*a* is provided for each compliance region 49, the atmosphere open path (not illustrated) is provided for each through-hole 48*a*, and each compliance region 49 is separately opened to the atmosphere. It is needless to say that there is no limitation to a method in which the space between the compliance region 49 and the cover head 130 is opened to the atmosphere, and two spaces between the compliance region 49 and the cover head 130 may communicate with each other such that the spaces are opened to the atmosphere through a common atmosphere open path.

Also, as illustrated in FIG. 3, FIG. 4, and FIG. 5, a cantilever 150 is provided in the compliance space 131 between the compliance region 49 and the cover head 130.

The cantilever 150 is provided to be continued from the frame-like member 47 in the second direction Y and to protrude in the compliance space 131. Further, in Embodiment 1, an end side of the cantilever 150, which is continuous to the frame-like member 47, is referred to as a support point side and the end side protruding into the compliance space 131 is referred to as a distal end side. In Embodiment 1, the cantilever 150 is provided to protrude toward the center of the compliance space 131 from the frame-like member 47 on both sides of the compliance space 131 in the second direction Y. The distal ends of the cantilevers 150 protruding from both sides in the second direction Y face to be separated in the second direction Y at a predetermined interval. In addition, a plurality of the cantilevers 150 are provided in the compliance space 131 to be separated at intervals in the first direction X.

Such cantilever 150 is fixed to at least a part of the flexible member 46 of the compliance region 49 and the distal end side becomes an unfixed region which is not fixed to the cover head 130.

Specifically, an entire surface of the cantilever 150, which faces to the flexible member 46, is fixed to the flexible member 46. In Embodiment 2, since the adhesive layer 46*a* is provided all over the entire surface of the flexible member 46, the flexible member 46 and the cantilever 150 adhere to each other by the adhesive layer 46*a*. Further, at least a part of the cantilever 150 may be fixed to the flexible member 46, and the portion where the cantilever 150 is fixed to the flexible member 46 may be the distal end side or the support point side.

In addition, the cantilever 150 has a first notch 151 on the distal end side in a surface of the cantilever 150, which faces the cover head 130. The distal end side is thinner in thickness compared to the support point side of the cantilever 150. Also, the portion at which the first notch 151 of the cantilever 150 is referred to as an unfixed region at which the cantilever is not fixed to the cover head 130 and the portion, at which the first notch 151 of the cantilever 150 is not provided, is fixed to the cover head 130. In other words, when the frame-like member 47 and the cover head 130 adhere to each other using the adhesive 135, and stray adhesive 135 from between the frame-like member 47 and the cover head 130 is accumulated, by the first notch 151, at the support point side from the first notch 151 and it is possible to suppress the flow of the adhesive 135 to the distal end side from the first notch 151. It is possible to hereby form the unfixed region of the cantilever 150 without variation. Incidentally, the first notch 151 may not be provided and there is a concern that it is difficult to control a flowing-out amount and a flowing position of the adhesive 135 between the frame-like member 47 and the cover head 130 above the cantilever 150 in a case where the first notch 151 is not provided and thus variations in the unfixed region are likely to occur. In Embodiment 2, the distal end side of the first notch 151 provided in the cantilever 150 is thinner and it is possible to suppress the flowing out of the adhesive 135 and to form the unfixed region with ease and high accuracy. Further, an application region and viscosity of the adhesive 135 is adjusted, and thereby it is possible to suppress stray of the adhesive 135 even when the first notch 151 is not provided and it is possible to define the unfixed region. In addition, the support point side from the first notch 151 of the cantilever 150 may be fixed to the cover head 130 or may not be fixed. In Embodiment 2, the support point side from the first notch 151 of the cantilever 150 is fixed to the cover head 130.

Figure 6A:
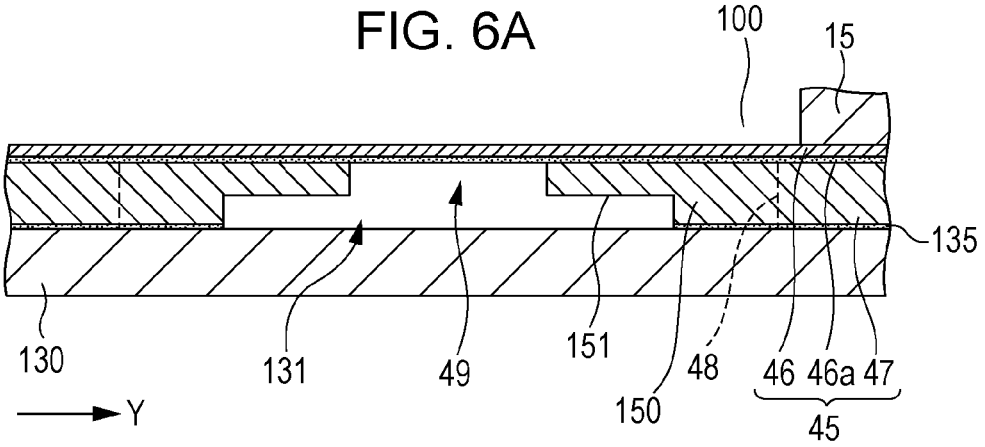
FIGS. 6A to 6C are sectional views illustrating main components of the recording head according to Embodiment 1.
Figure 6B:
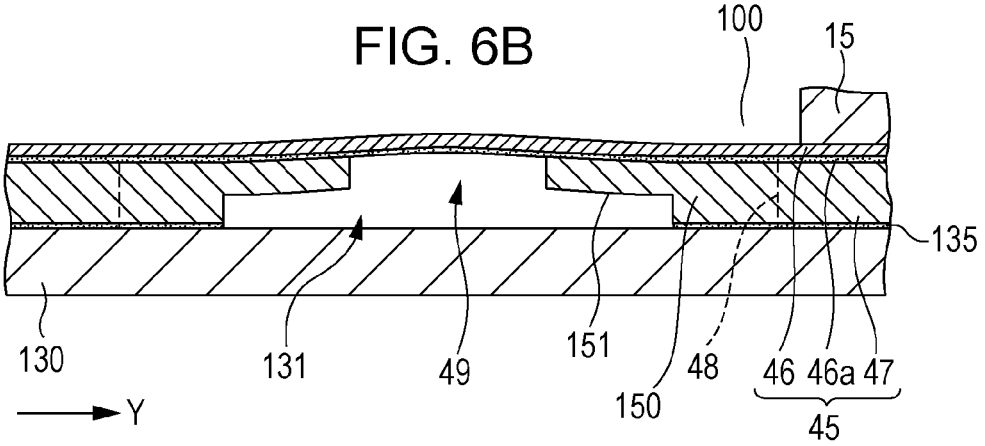

Here, since, in the stand-by state in which the ink is not ejected, the pressure in the ink in the manifold 100 becomes the negative pressure (with the atmospheric pressure as the reference), as illustrated in FIG. 6B, the compliance region 49 of the flexible member 46 is deformed in deflection to the side opposite to the cover head 130 toward the inside of the manifold 100, that is, in the third direction Z. At this time, since the cantilever 150 is formed in the compliance region 49, the deflection of the compliance region 49 is suppressed by the cantilever 150.

Figure 6C:
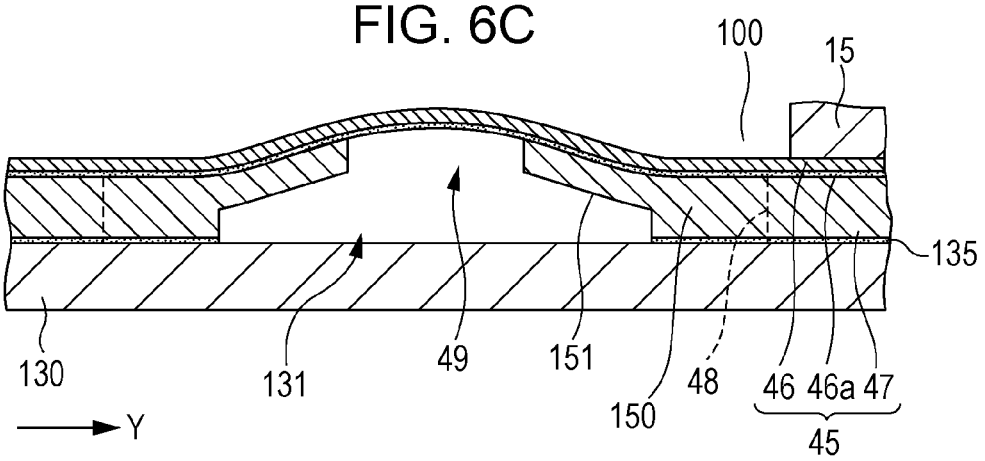

Also, when the ink is ejected and the pressure in the manifold 100 becomes further the negative pressure, as illustrated in FIG. 6C, the compliance region 49 of the flexible member 46 causes the cantilever 150 to be elastically deformed and the compliance region is deformed in deflection to further protrude to the inside of the manifold 100. In this manner, since the compliance region 49 in which the cantilever 150 is provided, can absorb the pressure fluctuation of the ink in the manifold 100 when the printing is started and during the printing, it is possible to suppress variations in the ejection characteristics of the ink during the printing, or particularly, in the weight of the ink droplet, and it is possible to improve the printing quality.

Figure 7A:
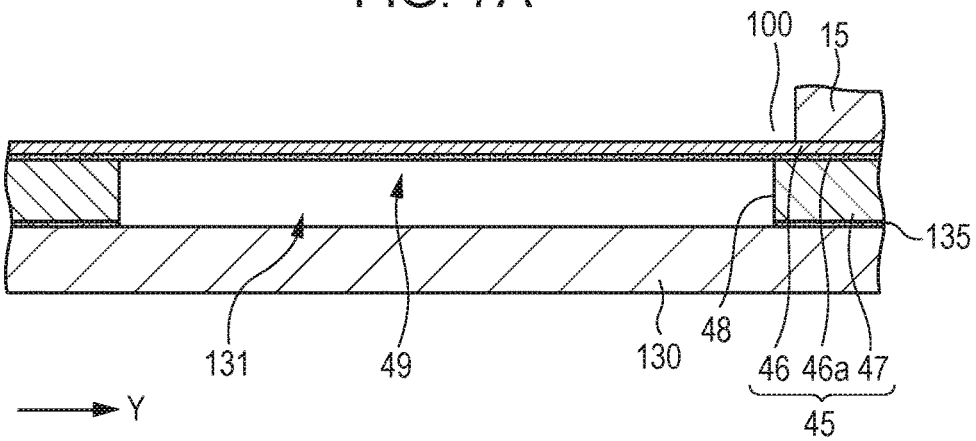
FIGS. 7A and 7B are sectional views illustrating the main components of a comparative example of the recording head according to Embodiment 1.
Figure 7B:
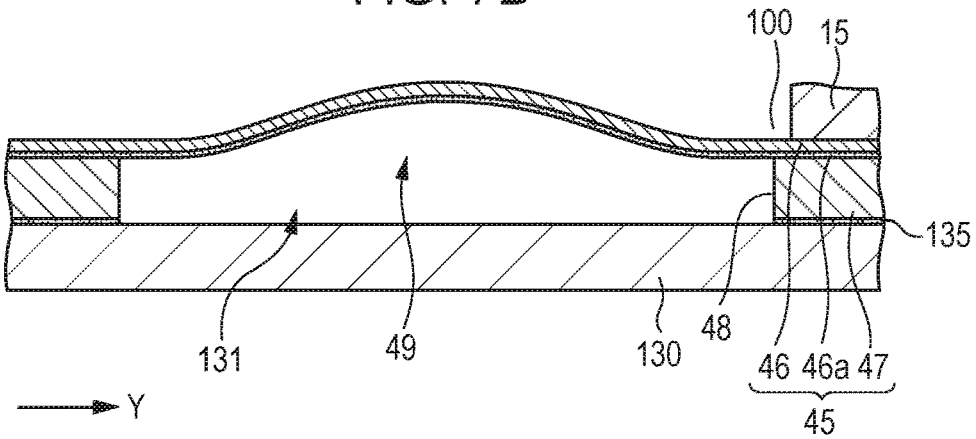

In comparison, in a case where the cantilever 150 is not provided, as illustrated in FIG. 7B, and when the deflection of the compliance region 49 to the inside of the manifold 100 is performed in the print stand-by state, the ink in the manifold 100 is consumed, and thereby it is not possible for the compliance region 49 to perform sufficient deflection in response to the pressure change. In addition, when the ink in the manifold 100 is consumed through ejection of the ink, the ink is supplied to the manifold 100 from the upstream side; however, the pressure change is delayed in the ink in the manifold 100 through supply of the ink. Accordingly, immediately after the ejection of the ink, after the ejection of the ink is performed a certain period, the pressure fluctuation of the ink in the manifold 100 is not absorbed by the compliance region 49 and variations in the ejection characteristics of the ink and, particularly, in the weight of the ink droplet are likely to occur.

Figure 8:
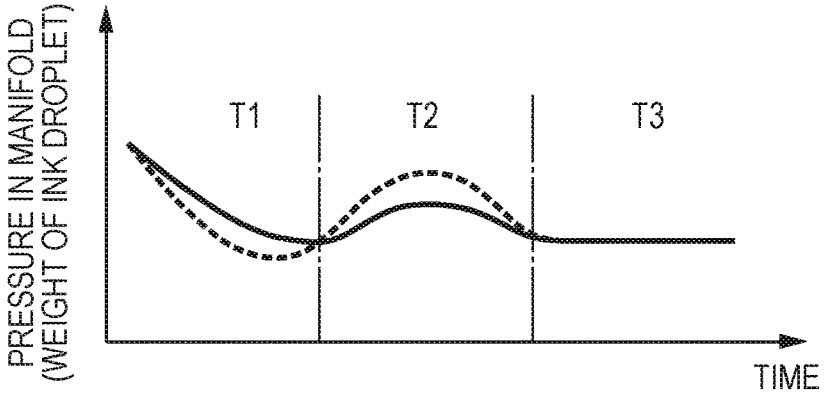
FIG. 8 is a graph illustrating pressure fluctuation according to Embodiment 1.

Here, the pressure fluctuation in the manifold 100 when the ejection of the ink is started form a stand-by state, that is, an example of a relationship between the weight of the ink droplet and time is illustrated in FIG. 8. Further, in FIG. 8, Example in which the cantilever is provided is shown in a solid line and Comparative Example in which the cantilever is not provided is shown in a dash line.

As illustrated in FIG. 8, in a case of Comparative Example in which the cantilever 150 is not provided, since it is not possible for the compliance region 49 to absorb the pressure fluctuation, in T1 immediately after the ejection of the ink is started although the ink in the manifold 100 is consumed, the pressure in the manifold 100 becomes significantly the negative pressure. In T1, the weight of the ink droplet ejected is hereby reduced and the printing concentration becomes weak. Also, in T2 after T1, the pressure in the manifold 100 becomes temporarily positive pressure due to back action when the ink is supplied in the manifold 100 from the upstream side. In T2, the weight of the ink droplet is hereby increased and the printing concentration becomes thick. Then, the compliance region 49 absorbs the pressure fluctuation of the ink in the manifold 100 in T3, the pressure in the manifold 100 is stabilized, and the weight of the ink droplet is intermediate, that is, the printing concentration becomes intermediate.

In comparison, in a case of Example in which the cantilever 150 is provided, the compliance region 49 can absorb the pressure fluctuation in the manifold 100. Therefore, a difference of the ink pressure in the manifold 100 is reduced in T1, T2, and T3 and it is possible to reduce further a difference in the weight of the ink droplet, compared to Comparative Example. Accordingly, the cantilever 150 is provided and thereby it is possible to suppress variations in the weight of the ink droplet to be ejected and it is possible to improve the printing quality.

Incidentally, although it is considered that, the flexible member 46 is formed of a material which is unlikely to deform, for example, the flexible member 46 having a great thickness, or a material which is unlikely to deform without changing the thickness of the flexible member 46, it is not preferable that the flexible member 46 is unlikely to deflect and the compliance performance is likely to deteriorate, the reactivity of the deflected deformation of the compliance region 49 in response to the pressure fluctuation of the ink in the manifold 100 deteriorates and variation in the ejection characteristics of the ink is likely to be occur. In Embodiment 2, the cantilever 150 is provided, using the flexible member 46, it is possible to control the variations in ejection characteristics of the ink droplet without deteriorating the reactivity of the compliance region 49.

In addition, in Embodiment 2, since the distal ends of the cantilevers 150 protruding on both sides in the second direction Y face to be separated in the second direction Y at a predetermined interval, even when the cantilever 150 is provided, it is possible suppress interruption of the deformation of the compliance region 49 of the flexible member 46 to the greatest extent. In other words, in a case where the distal ends of the cantilever 150 protruding on both sides in the second direction Y are connected and not only the cantilever 150 but also the fixed beam (both-end fixed beam) are provided, the deformation of the compliance region 49 is slightly interrupted by the fixed beam, there is a concern that the absorption of the pressure fluctuation is not sufficiently performed by the compliance region 49.

Figure 9:
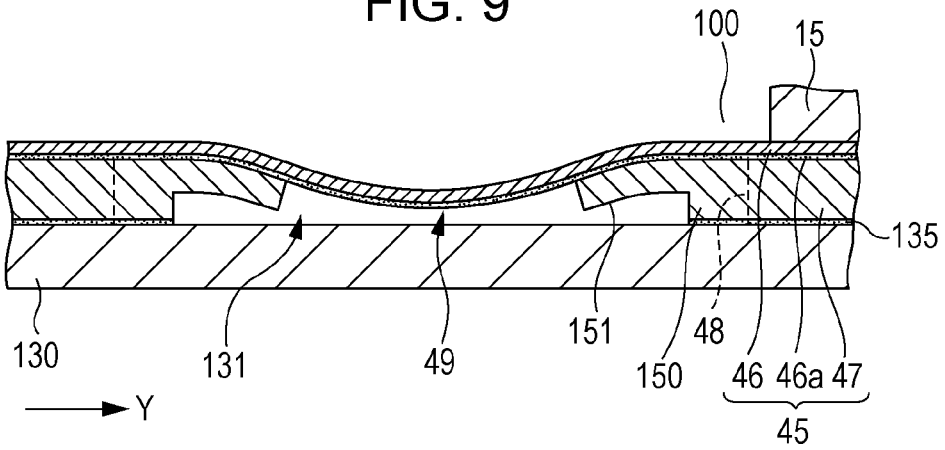
FIG. 9 is a sectional view illustrating main components of the recording head according to Embodiment 1.
Figure 10:
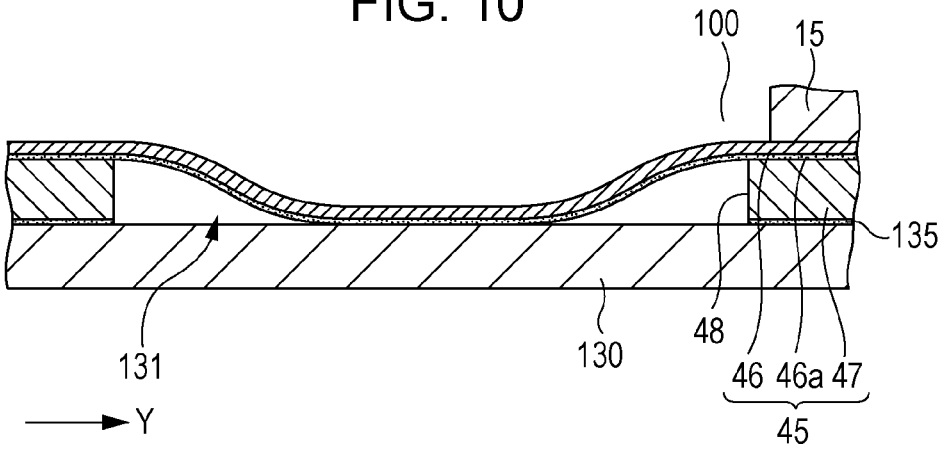
FIG. 10 is a sectional view illustrating the main components of a comparative example of the recording head according to Embodiment 1.

In addition, the cantilever 150 is provided, and thereby, as illustrated in FIG. 9, movement of the compliance region to the cover head 130 is regulated by the cantilever 150 when the compliance region 49 of the flexible member 46 moves to the cover head 130 side. Accordingly, the compliance region 49 of the flexible member 46 comes into contact with the cover head 130, and thereby it is possible to prevent the adhering therebetween. Incidentally, in a case where the cantilever 150 is not provided, as illustrated in FIG. 10, the compliance region 49 comes into contact with the cover head 130 and the adhesive layer 46*a* provided in the flexible member 46 restores adhesiveness under high-temperature and high-humidity surroundings, and thereby the compliance region 49 of the flexible member 46 adheres to the cover head 130. In addition, even in a case where the adhesive layer 46*a* is not provided in the compliance region 49, the compliance region 49 of the flexible member 46 adheres to the cover head 130 due to the condensation or the like. When the compliance region 49 of the flexible member 46 adheres to the cover head 130, it is not possible for the compliance region 49 to absorb the pressure fluctuation of the ink in the manifold 100. In Embodiment 1, it is possible to prevent the flexible member 46 from sticking to the cover head 130 by the cantilever 150, it is possible to prevent the compliance region 49 from adhering and malfunctioning of the absorption of the pressure fluctuation of the ink in the manifold 100, and it is possible to prevent variations in the ejection characteristics of the ink. Further, when the compliance region 49 is deformed in deflection to the cover head 130 side, the cantilever 150 may come into contact with or may not come into contact with the cover head 130. For example, in a case where the cantilever 150 comes into contact with the cover head 130, one or both a region of the cantilevers 150, which faces the cover head 130, and a surface of the cover head 130, which faces the cantilevers 150 are subjected to a water repellent treatment, and thereby it is possible to prevent the water moisture due to the condensation or the like from attaching to the region in which both the cover head and the cantilever come into contact with each other and it is possible to prevent adherence therebetween due to the water moisture.

Further, as described above, the pressure in the manifold 100 is the negative pressure during the stand-by or printing. Therefore, the deformation of the compliance region 49 to the cover head 130 may occur in a case where the recording head II is transported in a state in which the recording head is not filled with the ink. Accordingly, the manifold 100 is not filled with the ink and it is difficult for the compliance region 49 to move to the cover head 130 against an elastic force of the cantilever 150. In other words, when the cantilever 150 is provided, it is possible to prevent adherence of the compliance region 49 to the cover head 130 by coming into contact with the cover head during transport or the like.

Embodiment 2

Figure 11:
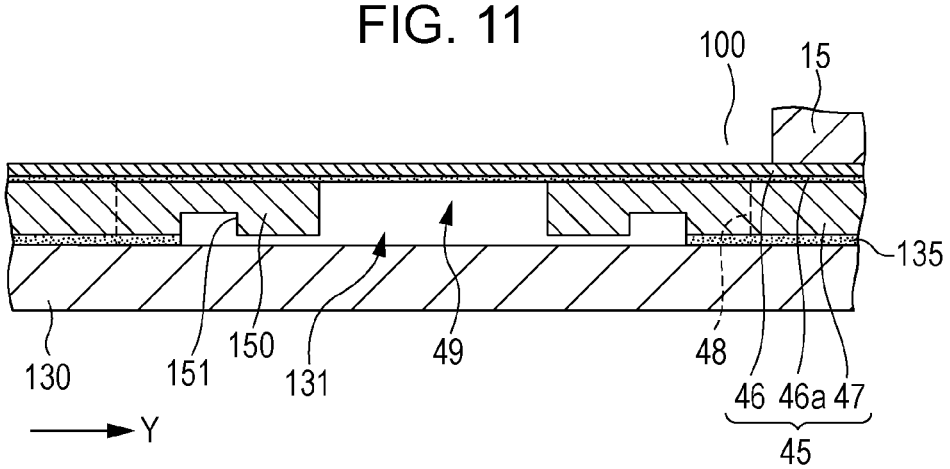
FIG. 11 is a sectional view illustrating the main components of the recording head according to Embodiment 2.
Figure 12:
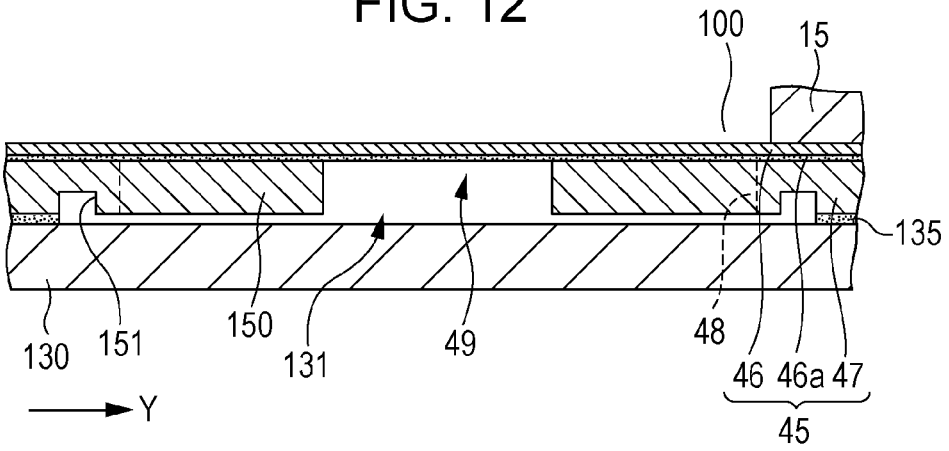
FIG. 12 is a sectional view illustrating the main components of the recording head according to Embodiment 2.

FIG. 11 is an enlarged sectional view illustrating the main components of the ink jet-type recording head according to Embodiment 2 of the invention. FIG. 12 is an enlarged sectional view illustrating the main components of the ink jet-type recording head according to Embodiment 2 of the invention. Further, the same reference sighs are assigned to the same members as in the Embodiment 1 described above and repetitive description is omitted.

As illustrated in FIG. 11, the cantilevers 150 are provided in the compliance space 131 between the flexible member 46 and the cover head 130. A first notch 151 is provided between the support point side and the distal end side on the surface of the cantilever 150, which faces the cover head 130. In this manner, although the cantilever 150 has both side of the first notch 151, that is, the support point side and the distal end side which are formed to have the same thickness, it is possible to prevent the adhesive 135, with which the frame-like member 47 and the cover head 130 adhere, from flowing out to the distal end side of the cantilever 150 due to the first notch 151. Accordingly, it is possible to easily form an unfixed region including the first notch 151 of the cantilever 150 on the distal end side from the first notch 151. Further, the first notch 151 may be provided on the support point side of the cantilever 150.

In addition, as illustrated in FIG. 12, the first notch 151 may be provided on not only the cantilever 150 but also on a surface of the frame-like member 47, which faces the cover head 130. In this manner, even when the first notch 151 is provided at a portion of the frame-like member 47 other than the cantilever 150, the first notch 151 causes the adhesive 135 not to flow to the cantilever 150 side and it is possible to easily form the unfixed region on the distal end side of the cantilever 150. In other words, the distal end side of the cantilever 150 becomes the unfixed region, which means both that the unfixed region is formed only on the distal end side of the cantilever 150 and that the unfixed region is formed on the entire cantilever 150 including the distal end side.

Embodiment 3

Figure 13:
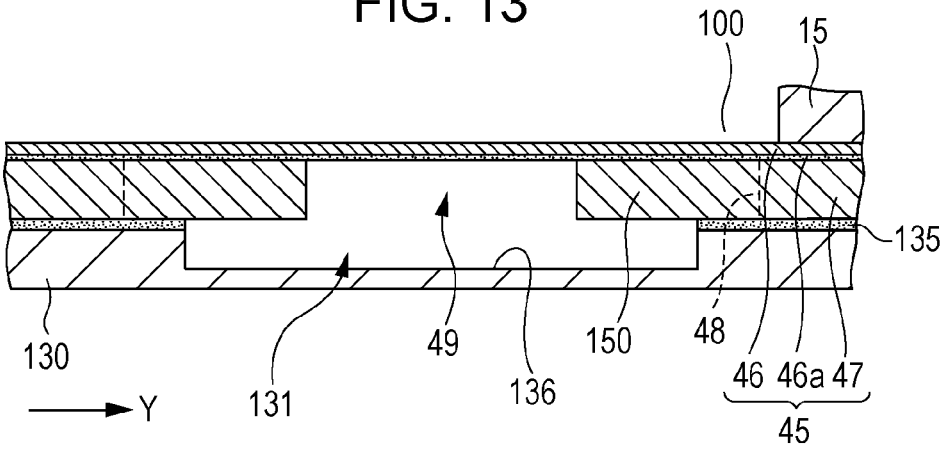
FIG. 13 is a sectional view illustrating the main components of the recording head according to Embodiment 3.

FIG. 13 is an enlarged sectional view illustrating the main components of the ink jet-type recording head according to Embodiment 3 of the invention. Further, the same reference sighs are assigned to the same members as in the Embodiments 1 and 2 described above and repetitive description is omitted.

As illustrated in FIG. 13, the frame-like member 47 has the cantilever 150 having the same thickness as the frame-like member 47. In addition, a second notch 136 is provided in a surface of the cover head 130, which faces the cantilevers 150. The second notch 136 is disposed to be separated from the cover head 130 and the cantilevers 150. Also, the second notch 136 is provided, and thereby it is possible to prevent the adhesive 135, with which the frame-like member 47 and the cover head 130 adhere, from flowing over the cantilevers 150 facing the second notch 136. In other words, the portion of the cantilevers 150, which faces the second notch 136, becomes the unfixed region which is not fixed to the cover head 130 of Embodiment 3.

Such a configuration also has the same effect as in Embodiment 1 described above, that is, it is possible to prevent variations of the ejection characteristics of the ink droplet from occurring by using the cantilever 150.

Further, similar to the first notch 151 in FIG. 11 described above, the second notch 136 may be provided at a part of the region facing the cantilever 150 or, similar to the first notch 151 in FIG. 12, the second notch may be provided at a portion facing the region in which the cantilevers 150 of the frame-like member 47 are not provided. In this manner, the second notch 136 can also prevent the adhesive 135 from flowing to the distal end side of the cantilever 150 and it is possible to easily form the unfixed region on the distal end side of the cantilever 150.

Embodiment 4

Figure 14:
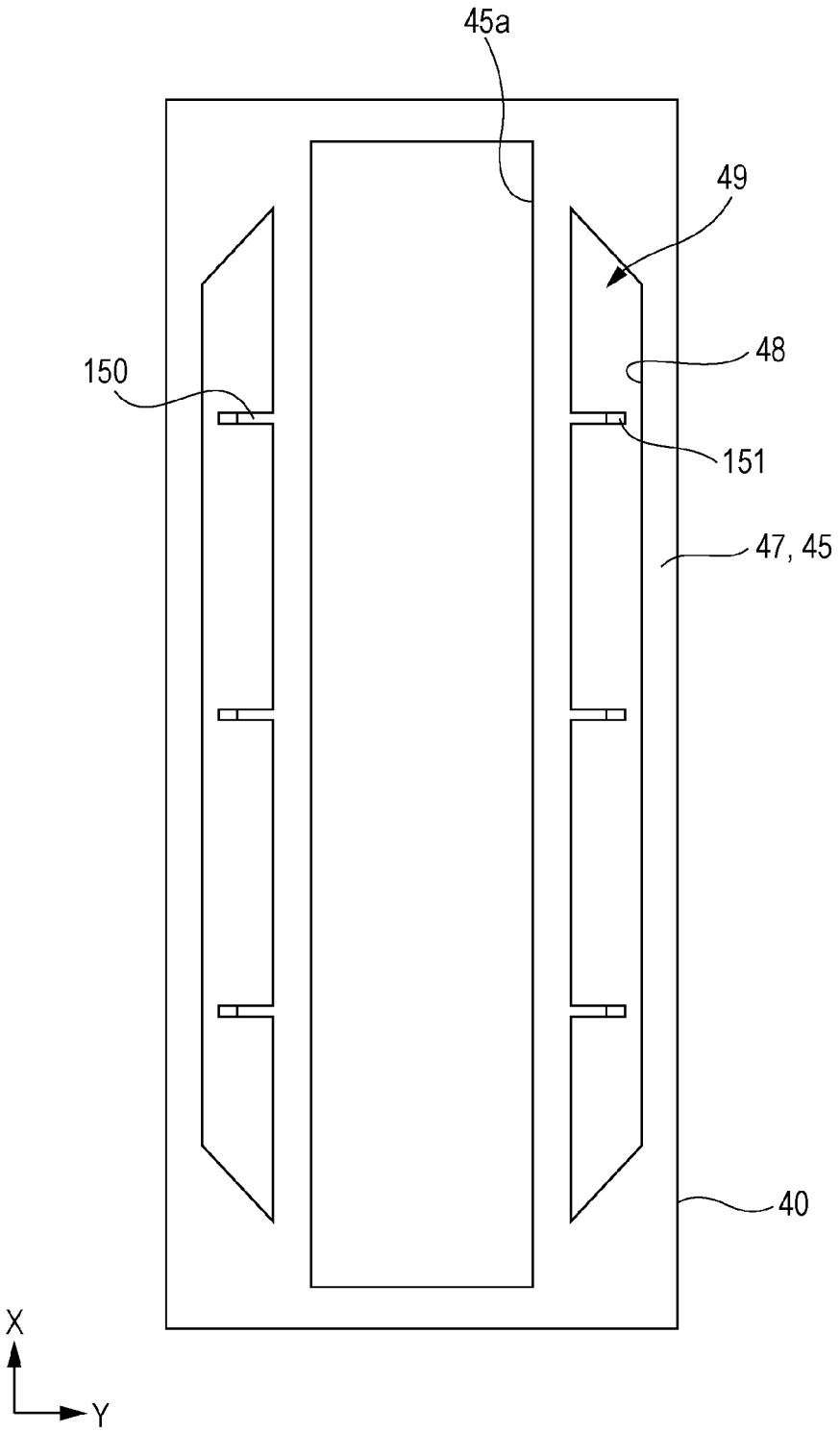
FIG. 14 is a plan view illustrating a compliance substrate according to Embodiment 4.
Figure 15:
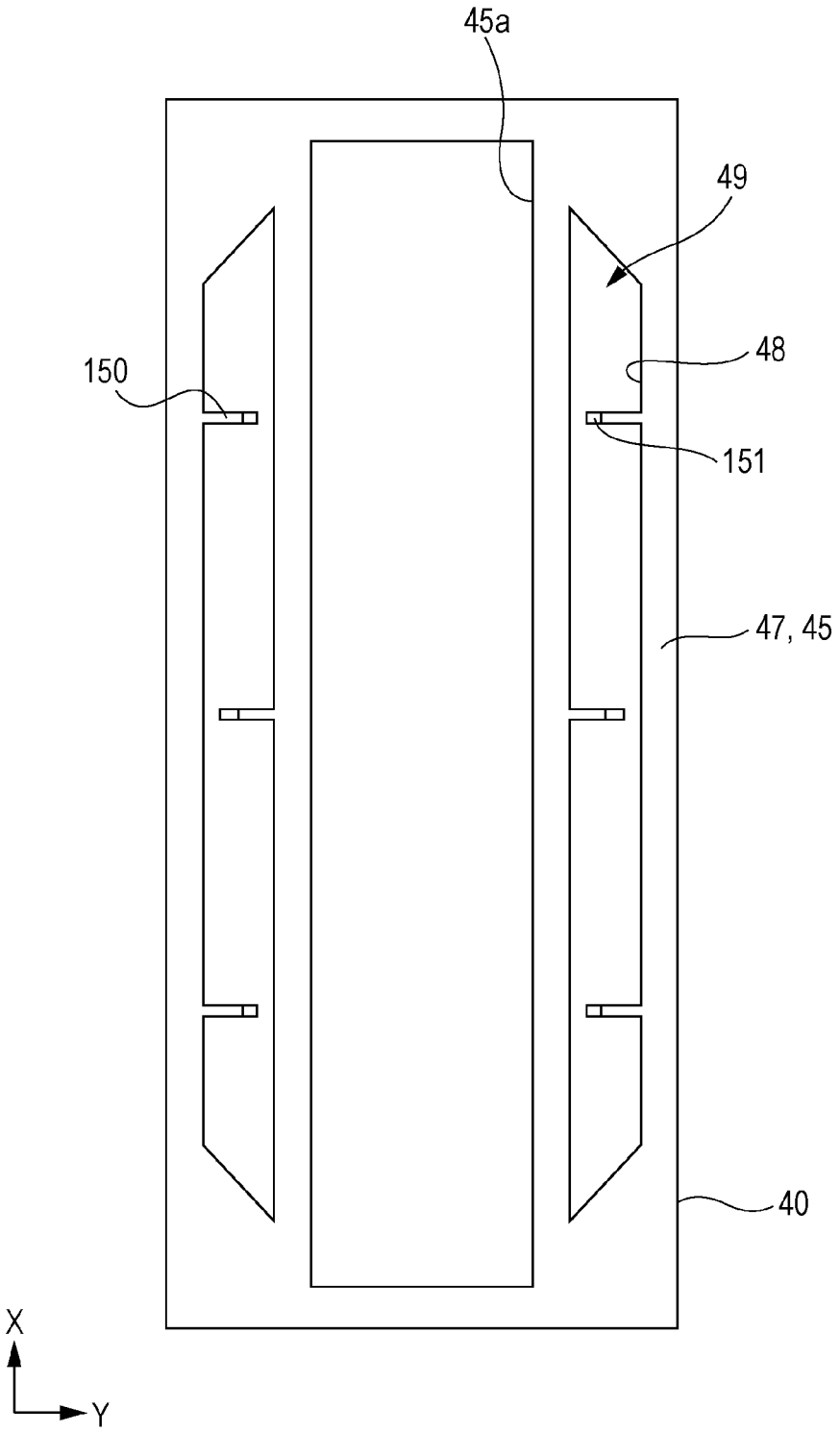
FIG. 15 is a plan view illustrating a compliance substrate according to Embodiment 4.

FIG. 14 is a plan view illustrating a compliance substrate according to Embodiment 4 of the invention. FIG. 15 is a plan view illustrating a modification example of the compliance substrate according to Embodiment 4. Further, the same reference sighs are assigned to the same members as in the Embodiments 1 to 3 described above and repetitive description is omitted.

As illustrated in FIG. 14, the frame-like member 47 has the cantilever 150 provided to protrude to the inside of the compliance space 131. The cantilever 150 has a notch 151 on the distal end side. Such a cantilever 150 extends from one side of the opening 48 in the second direction Y, that is, from the first exposure opening 45*a* side with the first exposure opening 45*a* as the support point side in Embodiment 4, and the distal end of the cantilever 150 and the other side of the opening 48 are disposed to be separated from each other. Similar to Embodiment 1 described above, such cantilever 150 can also prevent variation in the ejection characteristics of the ink from occurring.

In addition, as illustrated in FIG. 15, the plurality of cantilevers 150 may be disposed alternately in the second direction Y such that the support point sides are one side and the other side of the opening 48 in the second direction Y. Even in such a case, similar to Embodiment 1 described above, the cantilever 150 can prevent variations in the ejection characteristics of the ink from occurring.

Embodiment 5

Figure 16:
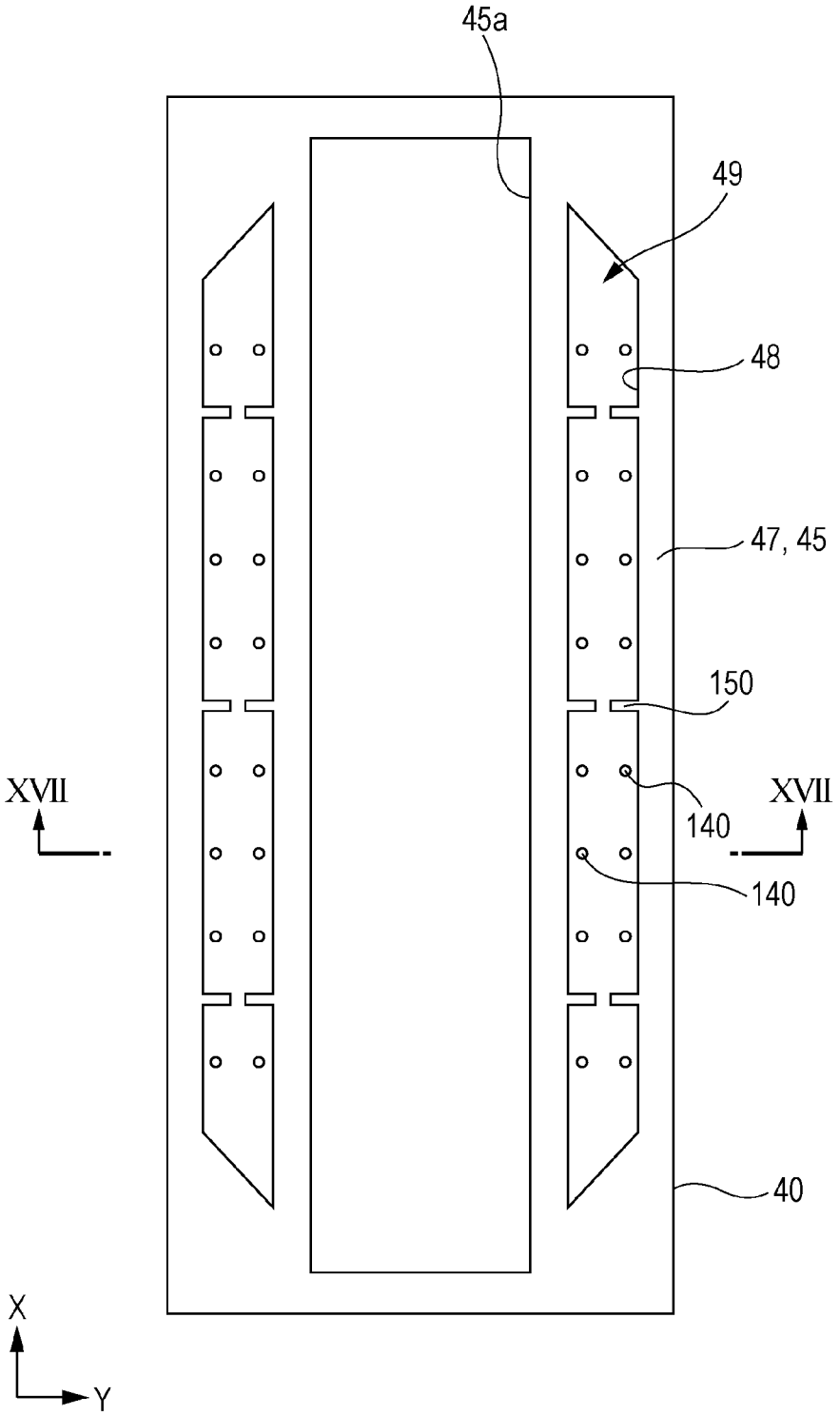
FIG. 16 is a plan view illustrating a compliance substrate according to Embodiment 5.
Figure 17:
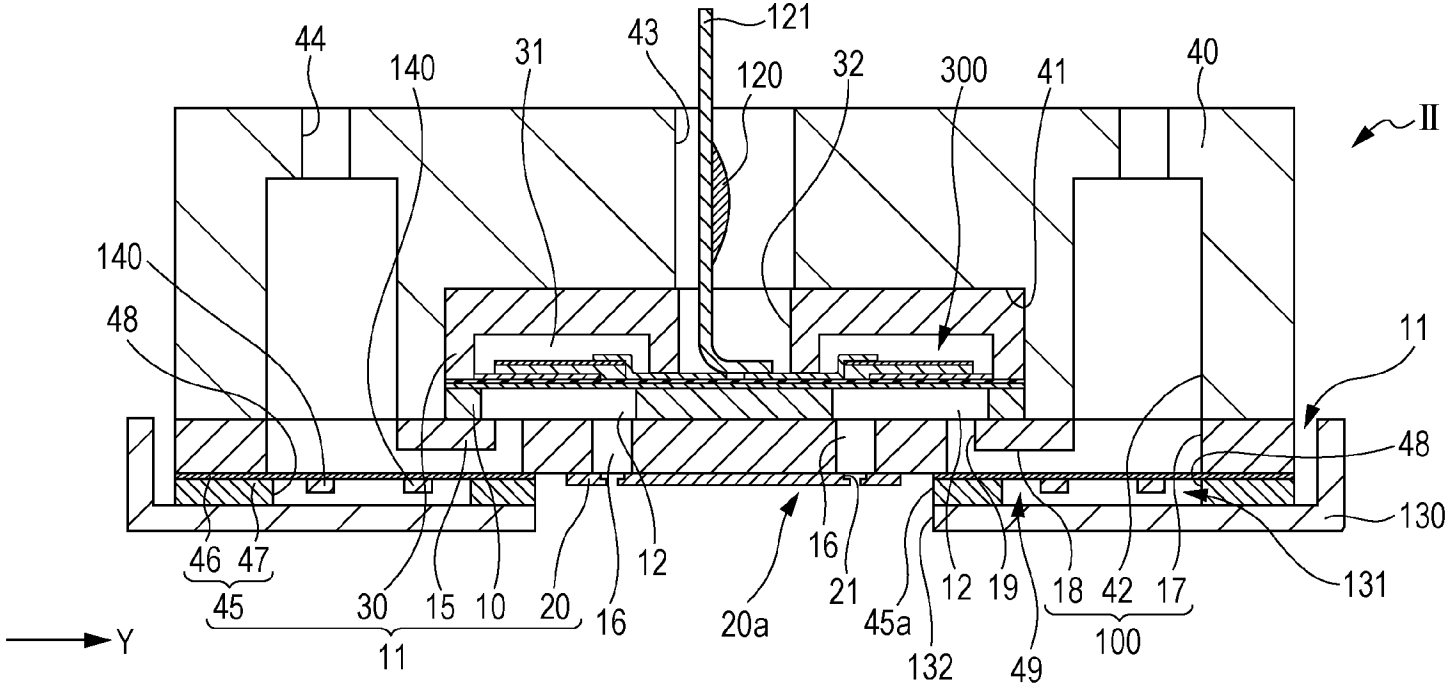
FIG. 17 is a sectional view illustrating a recording head according to Embodiment 5.
Figure 18:
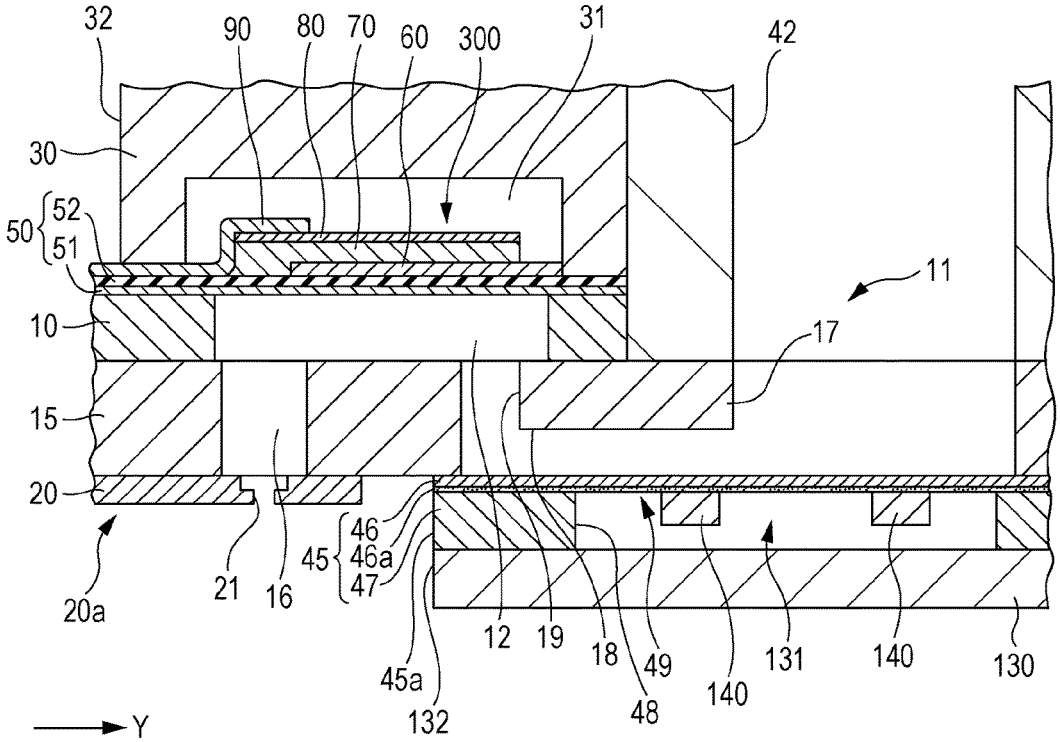
FIG. 18 is a sectional view illustrating the main components of the recording head according to Embodiment 5.

FIG. 16 is a plan view illustrating a compliance substrate of the ink jet-type recording head according to Embodiment 5 of the invention. FIG. 17 is a sectional view taken along line XVII-XVII in FIG. 16. FIG. 18 is an enlarged sectional view illustrating the main components in FIG. 17. Further, the same reference sighs are assigned to the same members as in the Embodiments 1 to 4 described above and repetitive description is omitted.

As illustrated in the drawings, the same cantilever 150 and island-like member 140 as in Embodiment 1 as described above, are provided in the compliance space 131 between the compliance region 49 and the cover head 130.

Here, the island-like member 140 is provided to be disconnected from the frame-like member 47, one surface of the surface on the side facing the flexible member 46 and the surface on the side facing the cover head 130 is fixed to the facing member, and the other surface is not fixed to the facing member. In other words, the island-like member 140 is fixed to one of the flexible member 46 and the cover head 130 and is not fixed to the other one. In Embodiment 5, the island-like member 140 is fixed to the flexible member 46 and is not fixed to the cover head 130. Further, the island-like member 140 is fixed to the flexible member 46 through the adhesive layer 46*a* provided on the flexible member 46 on the cover head 130 side.

In addition, the island-like member 140 is thinner in thickness than the frame-like member 47 in a direction in which the flexible member 46 faces the cover head 130, that is, in the third direction Z. In other words, it is preferable that the island-like member 140 is thinner in thickness than the frame-like member 47 on the support point side of the cantilever 150, in the third direction Z.

Further, the island-like member 140 is disposed with the center thereof in the second direction Y shifted in the second direction Y which is the widthwise direction of the compliance region 49. Specifically, in Embodiment 5, two island-like members 140 are provided on both sides of the center of the compliance region 49 in the second direction Y, respectively. In addition, a plurality of sets of the two island-like members 140 arranged in parallel in the second direction Y are arranged at predetermined intervals in the first direction X which is the longitudinal direction.

Figure 19A:
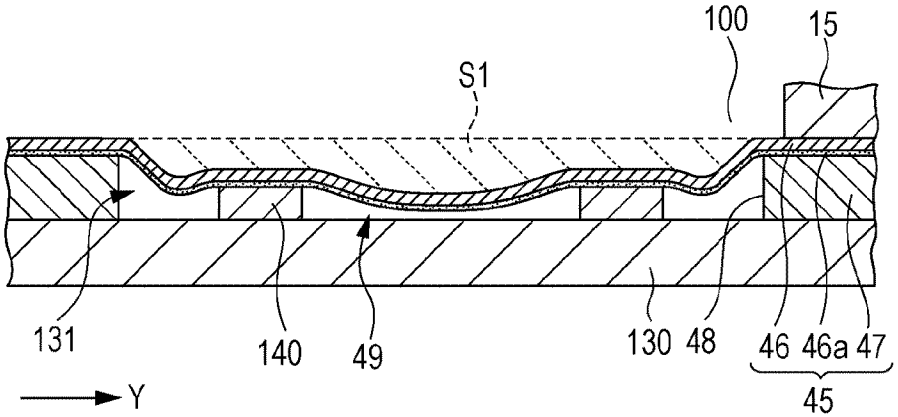
FIGS. 19A and 19B are sectional views illustrating the main components of the recording head according to Embodiment 5.
Figure 19B:
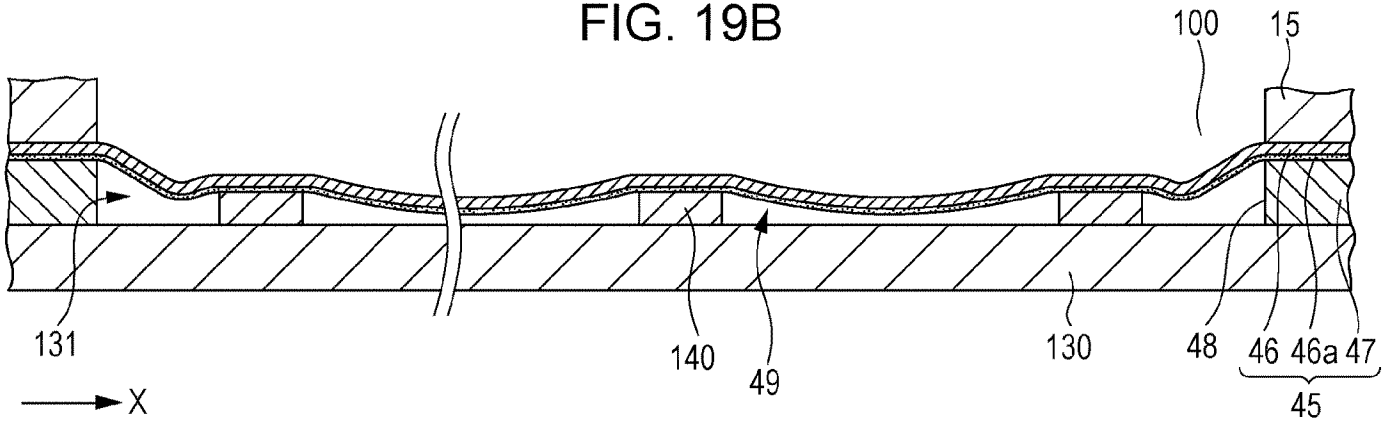

In this manner, the island-like members 140 are provided in the compliance space 131 between the compliance region 49 and the cover head 130, and thereby, as illustrated in FIGS. 19A and 19B, the island-like members 140 come into contact with the cover head 130 when the compliance region 49 is deformed in deflection to the cover head 130 side. Thus, it is possible to prevent the compliance region 49 from coming into contact with and thereby adhering to the cover head 130. Further, in Embodiment 5, the plurality of island-like members 140 are provided in parallel in the first direction X and the second direction Y, and thereby it is possible to prevent the compliance region 49 from adhering to the cover head 130 in both the first direction X and the second direction Y.

Figure 20A:
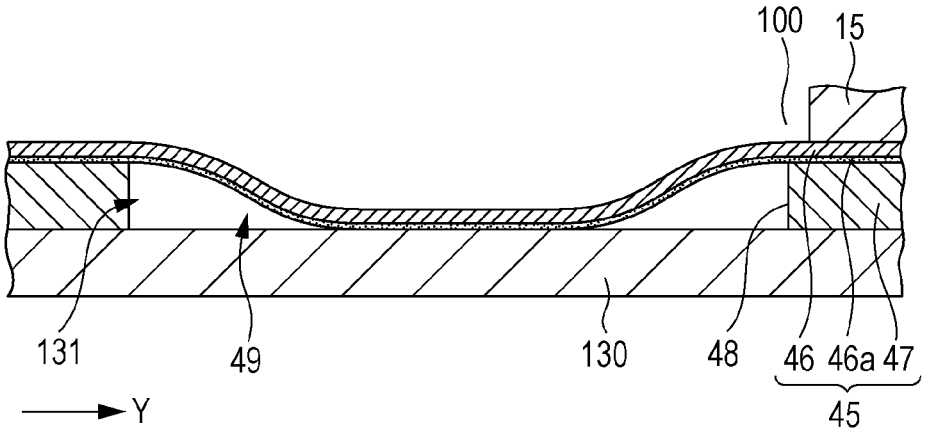
FIGS. 20A and 20B are sectional views illustrating the main components of a comparative example of the recording head according to Embodiment 5.

In comparison, as illustrated in FIG. 20A, in a case where the island-like member 140 is not provided, the compliance region 49 is deflected, and thereby the compliance region 49 comes into contact with and adheres to the cover head 130.

Further, in Embodiment 5, as illustrated in FIGS. 19A and 19B, even when the island-like members 140 are provided, the compliance region 49 passes over the island-like member 140 and is deformed in deflection to the cover head 130 side in the third direction Z. It is possible to hereby increase a volume S1 which increases the manifold 100 due to the deformation of the compliance region 49. In addition, although the compliance region 49 passes over the island-like member 140 and is deflected to the cover head 130, the thickness of the island-like member 140 may be to the extent that the compliance region 49 does not come into contact with the cover head 130.

Figure 20B:
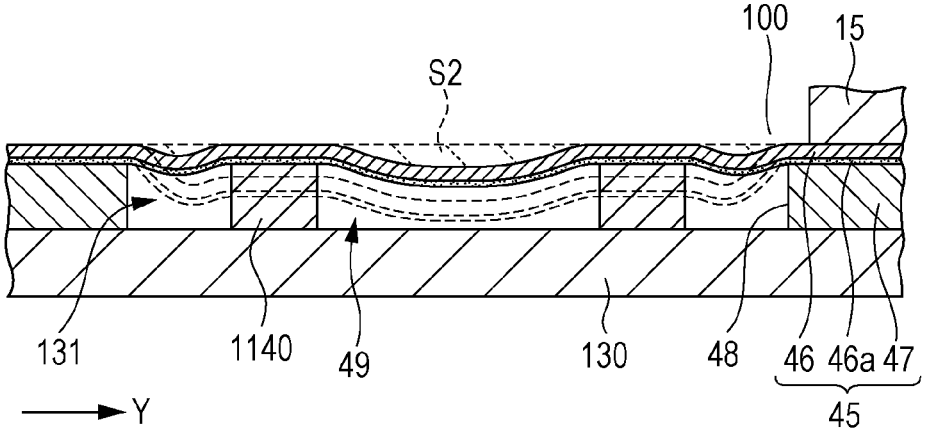
Figure 21:
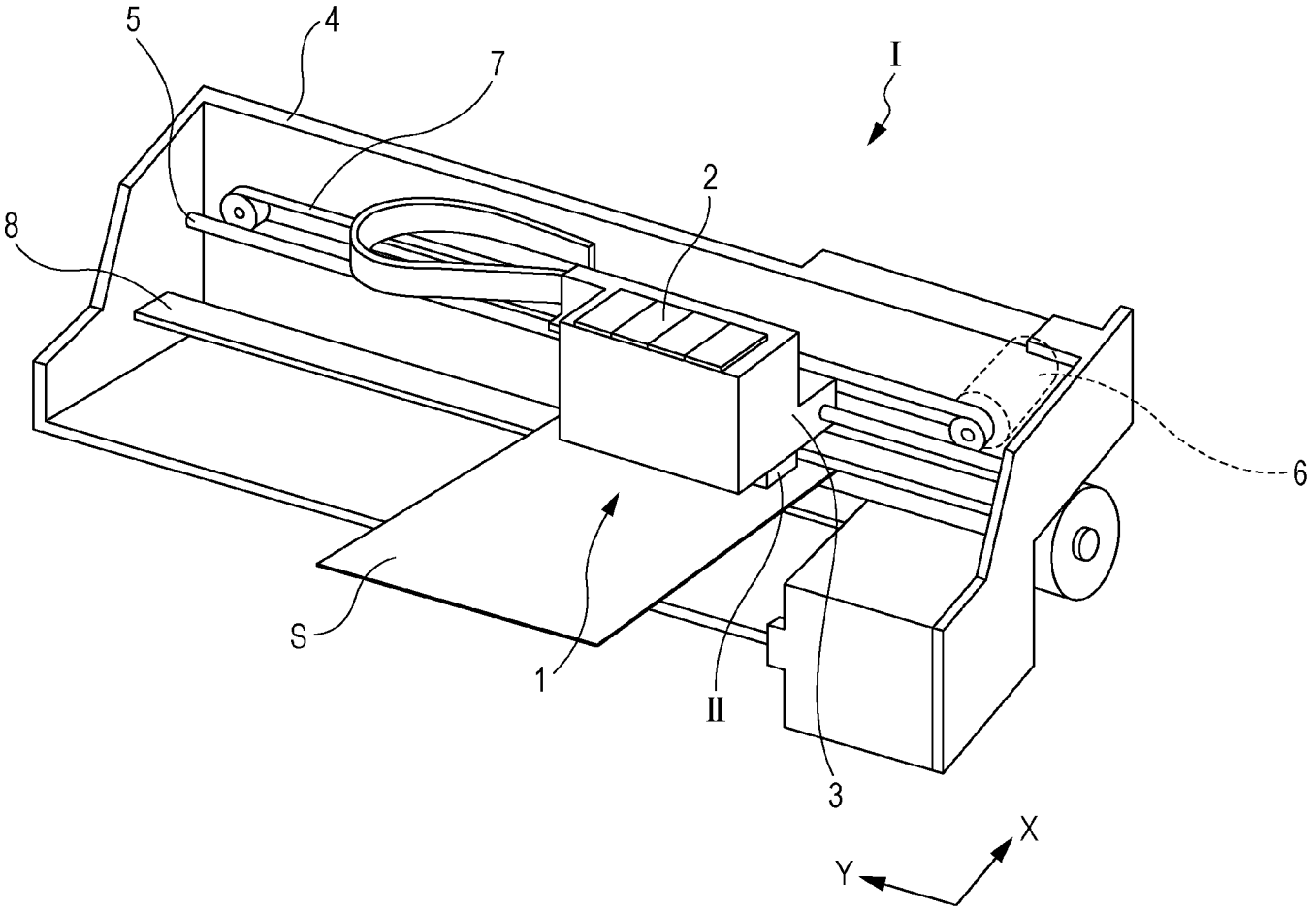
FIG. 21 is a view schematically illustrating a recording apparatus according to an embodiment of the invention.

Incidentally, as illustrated in FIG. 20B, even in a case where the island-like member 140 is provided to have the same thickness as the frame-like member 47, it is possible to prevent the compliance region 49 from coming into contact with and adhering to the cover head 130. However, since movement of the compliance region 49 to the cover head 130 side is regulated by the island-like member 140, a volume S2 which increases the manifold 100 due to the deflected deformation of the compliance region 49 is insufficient. In other words, in Embodiment 5, the island-like member 140 is thinner in thickness than the frame-like member 47, and thereby it is possible to perform expansion of the large volume S1 compared to the volume S2 which can expand the manifold 100 in a case where the island-like member 140 is provided to have the same thickness as the frame-like member 47 and it is possible to perform sufficient expansion of the volume of the manifold 100 while the compliance region 49 is prevented from adhering to the cover head 130. In addition, the island-like member 140 is thinner in thickness than the frame-like member 47 on the support point side of the cantilever 150, and thereby it is possible to prevent the island-like member 140 and the cover head 130 form coming into contact with each other when transport is performed in a state in which the manifold 100 is not filled with the ink, and it is possible to prevent the island-like member 140 and the cover head 130 from adhering.

In addition, in Embodiment 5, the island-like member 140 is fixed to the flexible member 46 and is not fixed to the cover head 130; however, the configuration is not limited thereto. The island-like member 140 may be fixed to the cover head 130 and may not be fixed to the flexible member 46. Here, in the case where the island-like member 140 is fixed to the cover head 130, in a configuration in which the adhesive layer 46*a* is formed to the compliance region 49 of the flexible member 46, there is a concern that the compliance region 49 will adhere to the island-like member 140 due to the adhesive layer 46*a*. However, although the compliance region 49 adheres to the island-like member 140 due to the adhesive layer 46*a*, the island-like member 140 has a small area. Therefore, it is possible to separate the compliance region 49 from the island-like member 140 using a relatively small force. It is needless to say that, when the island-like member 140 is fixed to the flexible member 46, it is possible to secure adherence by the adhesive layer 46*a* described above.

OTHER EMBODIMENTS

As above, the embodiments of the invention are described; however, a basic configuration of the invention is not limited to the configuration described above.

For example, in Embodiments 1 and 2 described above, an example, in which two manifolds 100 are provided and compliance region 49 is provided for each manifold 100, is described; however, the configuration is not particularly limited thereto, and the manifold 100 which is divided in plurality in the first direction X may be provided.

In addition, in Embodiments 1 and 2 described above, the island-like members 140 are disposed at positions shifted from the center of the compliance region 49 in the second direction Y; however, the configuration is not limited thereto and as illustrated in FIG. 8A, the island-like member 140 may be disposed at the center of the compliance region 49 in the second direction Y.

Further, in Embodiments 1 and 2 described above, the compliance substrate 45 is provided on the surface side on which the nozzle plate 20 is provided; however, the configuration is not limited thereto and, for example, the compliance substrate 45 may be provided on the side surface orthogonal to the case member 40 side or the liquid ejection surface 20*a*. In other words, since the cap member is provided to demarcate the compliance space 131 between the compliance substrate 45 and the compliance region 49, the cap member is not limited to the cover head 130 described above, but another member is.

In addition, according to Embodiments 1 and 2 described above, as the pressure generator that causes the pressure change in the pressure generating chamber 12, the thin film type piezoelectric actuator 300 is described; however, the configuration is not particularly limited thereto. For example, it is possible to use a thick film type piezoelectric actuator that is formed by a method of such as attaching green sheets or the like, a longitudinal vibration type piezoelectric actuator in which piezoelectric materials and electrode forming materials are laminated alternately and expand and contract in an axial direction. In addition, as the pressure generator, it is possible to use an actuator in which a heating element is disposed in the pressure generating chamber and bubbles that is produced by heating of the heating element causes liquid droplets to be discharged from the nozzle, a so-called electrostatic actuator in which static electricity is generated between a vibrating plate and an electrode, the vibrating plate is deformed by electrostatic force and thus liquid droplets are discharged from the nozzle.

In addition, the ink jet-type recording head II according to each embodiment configures a part of an ink jet-type recording head unit that includes an ink flow path communicating with an ink cartridge or the like, and is mounted on an ink jet-type recording apparatus. FIGS. 20A and 20B are views schematically illustrating the ink jet-type recording apparatus.

In an ink jet-type recording apparatus I illustrated in FIGS. 20A and 20B, the ink jet-type recording head unit 1 having a plurality of the ink jet-type recording head II (hereinafter, also referred to as a head unit 1) is provided with an ink cartridge 2 that configures an ink supplying unit and is attachable/detachable and a carriage 3 on which the ink jet-type recording head unit 1 is mounted is provided to be movable in the axial direction on a carriage shaft 5 attached to an apparatus main body 4. For example, the recording head unit 1 is used for discharging a black ink composition and a color ink composition.

Also, a drive force of the drive motor 6 is transmitted to the carriage 3 through a plurality of gears (not illustrated) and a timing belt 7 and thereby the carriage 3 on which the ink jet-type recording head unit 1 is mounted moves along the carriage shaft 5. A transport roller 8 is provided as a transport unit in the apparatus main body 4 and a recording sheet S that is a recording medium such as paper is transported by the transport roller 8. The transport unit that transports the recording sheet S is not limited to the transport roller 8, but may be a belt, drum, or the like.

In the ink jet-type recording apparatus I described above, the ink jet-type recording head II (head unit 1) is mounted on the carriage 3 and moves in a main scanning direction; however, the configuration is not limited thereto. For example, it is possible to apply the invention even to a so-called line-type recording apparatus in which the ink jet-type recording head II is fixed, the recording sheet S such as paper is caused to move only in a sub scanning direction, and thereby printing is performed.

In addition, in the examples described above, the ink jet-type recording apparatus I has a configuration in which the ink cartridge 2 that is a liquid reservoir is mounted on the carriage 3, the configuration is not limited thereto. For example, the liquid reservoir such as an ink tank is fixed to the apparatus main body 4 and the reservoir and the ink jet-type recording head II may be connected through a supply pipe such as a tube. In addition, the liquid reservoir may not be mounted on the ink jet-type recording apparatus.

Further, broad parts of a liquid ejecting head in general are targets of the invention and, for example, the invention can be applied to a recording head such as various ink jet-type recording heads which are used in an image recording apparatus such as a printer, a color-material ejecting head that is used to manufacture a color filter such as a liquid crystal display, an electrode-material ejecting head that is used to produce an electrode, such as an organic EL display or a field emission display (FED), and a bio-organic material ejecting head that is used to manufacture a bio chip.

What is claimed is:

1. A liquid ejecting head comprising:

a plurality of pressure generating chambers communicating with nozzles through which a liquid is ejected;

a manifold communicating with the plurality of pressure generating chambers through separated flow paths with each of the pressure generating chambers;

a flexible member that defines a part of a wall of the manifold, and that has a compliance region configured to move in response to pressure fluctuation in the manifold;

a compliance space disposed on a side opposite to the manifold in relation to the flexible member; and a frame that defines a part of a wall of the compliance space, wherein the frame includes a cantilever that protrudes from the wall into the compliance space, wherein the cantilever has a thickness which is thinner on the distal end side than on the support point side in a direction in which the compliance region faces a cap member.

2. The liquid ejecting head according to claim 1, wherein the cantilever is fixed to the flexible member.

3. The liquid ejecting head according to claim 1, wherein the cantilever is configured to elastically deform toward the manifold.

4. The liquid ejecting head according to claim 1, wherein the cantilever is provided at each of the wall of the compliance space.

5. The liquid ejecting head according to claim 1, wherein the frame has a first notch provided on a surface facing a cap member, and wherein the surface of the frame on the cantilever side from the first notch on the surface thereof facing the cap member becomes an unfixed region.

6. The liquid ejecting head according to claim 1, wherein a cap member has a second notch in a surface facing the cantilever, and wherein the surface of the cap member on the distal end side of the cantilever from the second notch of the surface thereof facing the cantilever is not fixed to the frame-like member.

7. The liquid ejecting head according to claim 1, wherein the surface of a cap member on the distal end side of the cantilever of the cap member on the surface thereof facing the cantilever is further recessed than the support point side of the cantilever.

8. The liquid ejecting head according to claim 1, wherein a flow path member defining a wall surface of the manifold includes an opening in a surface of the flow path member, the opening facing the cantilever, the opening being positioned on the support point side from the distal end side of the cantilever.

9. The liquid ejecting head according to claim 1, further comprising:

an island-like member disposed in the compliance region to be apart from the frame, between the flexible member and a cap member, wherein a surface of the island-like member, which faces the flexible member, is fixed to the flexible member and a surface of the island-like member on the side facing the cap member is not fixed to the cap member.

10. The liquid ejecting head according to claim 9, wherein the island-like member is thinner in thickness than the cantilever on the support point side.

11. The liquid ejecting head according to claim 10, wherein the island-like member has the same thickness as the cantilever on the distal end side.

12. The liquid ejecting head according to claim 1, wherein a surface of the cantilever on the distal end side, which faces a cap member, is subjected to a water repellent treatment.

13. The liquid ejecting head according to claim 1, wherein a surface of the cap member, which faces the cantilever and faces the distal end side of the cantilever, is subjected to a water repellent treatment.

14. A liquid ejecting apparatus comprising:

the liquid ejecting head according to claim 1.

15. A liquid ejecting head comprising:

a plurality of pressure generating chambers communicating with nozzles through which a liquid is ejected;

a manifold communicating with the plurality of pressure generating chambers through separated flow paths with each of the pressure generating chambers;

a flexible member that defines a part of a wall of the manifold, and that has a compliance region configured to move in response to pressure fluctuation in the manifold;

a compliance space disposed on a side opposite to the manifold in relation to the flexible member; and a frame that defines a part of a wall of the compliance space, wherein the frame includes a cantilever that protrudes from the wall into the compliance space, wherein the frame has a first notch provided on a surface facing a cap member, and wherein the surface of the frame on the cantilever side from the first notch on the surface thereof facing the cap member becomes an unfixed region.

16. A liquid ejecting head comprising:

a plurality of pressure generating chambers communicating with nozzles through which a liquid is ejected;

a manifold communicating with the plurality of pressure generating chambers through separated flow paths with each of the pressure generating chambers;

a flexible member that defines a part of a wall of the manifold, and that has a compliance region configured to move in response to pressure fluctuation in the manifold;

a compliance space disposed on a side opposite to the manifold in relation to the flexible member;

a frame that defines a part of a wall of the compliance space, wherein the frame includes a cantilever that protrudes from the wall into the compliance space; and an island-like member disposed in the compliance region to be apart from the frame, between the flexible member and a cap member, wherein a surface of the island-like member, which faces the flexible member, is fixed to the flexible member and a surface of the island-like member on the side facing the cap member is not fixed to the cap member.

* * * * *